US005804358A

United States Patent [19]

Komatsu et al.

[11] Patent Number: 5,804,358

[45] **Date of Patent: *Sep. 8, 1998**

[54] DEVELOPING COMPOSITION FOR SILVER HALIDE PHOTOGRAPHIC LIGHT SENSITIVE MATERIAL

[75] Inventors: Hideki Komatsu; Shoji Nishio, both of Hino, Japan

[73] Assignee: Konica Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 755,980

[22] Filed: Nov. 25, 1996

[30] Foreign Application Priority Data

Nov. 29, 1995 [JP] Japan ..... 7-310644

[51] Int. Cl.[6] ..... G03C 5/305

[52] U.S. Cl. ..... 430/465; 430/480; 430/481; 430/483; 430/488

[58] Field of Search ..... 430/465, 480, 430/481, 483, 488

[56] References Cited

U.S. PATENT DOCUMENTS

| | | | |
|---|---|---|---|
| 4,816,384 | 3/1989 | Fruge et al. | 430/465 |
| 5,288,596 | 2/1994 | Hayashi | 430/465 |
| 5,362,610 | 11/1994 | Yoshimoto | 430/484 |
| 5,376,509 | 12/1994 | Yoshimoto et al. | 430/465 |
| 5,382,507 | 1/1995 | Shimizu | 430/465 |
| 5,405,732 | 4/1995 | Shimizu et al. | 430/465 |
| 5,510,231 | 4/1996 | Komatsu et al. | 430/465 |

FOREIGN PATENT DOCUMENTS

| | | |
|---|---|---|
| 0 518 352 A1 | 12/1992 | European Pat. Off. . |
| 0 518 541 A1 | 12/1992 | European Pat. Off. . |
| 0 540 296 A1 | 5/1993 | European Pat. Off. . |
| 7-114153 | 5/1995 | Japan . |

*Primary Examiner*—Hoa Van Le

*Attorney, Agent, or Firm*—Frishauf, Holtz, Goodman, Langer & Chick, P.C.

[57] ABSTRACT

A solid developing composition for a silver halide black-and-white photographic light sensitive material is disclosed, comprising a developing agent selected from the group consisting of a dihydroxybenzene compound and a compound represented by formula (A), and the developing composition further comprising a compound represented by formula (1).

Formula (A)

$$CH_3(CH_2)_n—(O)_mSO_3M$$

Formula (1)

12 Claims, No Drawings

DEVELOPING COMPOSITION FOR SILVER HALIDE PHOTOGRAPHIC LIGHT SENSITIVE MATERIAL

FIELD OF THE INVENTION

The present invention is related to a developer used for a silver halide photographic light sensitive material and a processing method by use thereof and particularly to a developer excellent in process stability and a processing method by use thereof.

BACKGROUND OF THE INVENTION

A silver halide photographic light sensitive material (hereinafter, referred to as a photographic material) is subjected, after exposure, to processing comprising the steps of developing, fixing and washing (alternatively, rinsing). The processing is conventionally conducted using an automatic processor. The processing by the processor is carried out with replenishing of processing chemicals so as to keep activity of a processing solution at a given level. However, there have been problems in the replenishing system. Deterioration of the developing solution includes process deterioration due to processing of photographic materials, and oxidation deterioration due to contact of the processing solution with air. With regard to the process deterioration, the activity can be relatively readily maintained by replenishing components which have been consumed in processing of the photographic materials. Regarding the air-oxidation deterioration over time, however, effects thereof are different depending on the processing amount of users. Thus, in the case of large amounts of processing, the proportion of the process deterioration to the air-oxidation deterioration increases and its effect is not as noticeable. In the case of small amounts of processing, in contrast, the proportion of the air-oxidation deterioration increases so that the activity is liable to vary. Furthermore, there also exists the serious problem that, as a result of desire to lower the replenishing rate, the developing solution in the processor becomes concentrated due to evaporation of water and its activity is also liable to vary.

There have been reported various improvements and study results. As a response regarding the processors, for example, it was proposed to make the air contact area as small as possible. However, this resulted in such a problem that it made the mechanism of a processor more complex, and did not necessarily satisfy the desire, though it was put into partial practical use. A technique in which replenishment was optimally conducted in accordance with a program taking into account the processing amount of photographic materials, replenishing amount and working time of a processor was proposed and it was put into practice. This technique, however, was too difficult for the user with small amounts of processing, to reduce the replenishing amount, and from the expectation for an increase of a combined mode as an outputting machine and a processor, for the purpose of reducing work time in the darkroom, this technique is found to be insufficient at the present.

SUMMARY OF THE INVENTION

In response to the above problems, the present invention is to provide a developer used for a silver halide photographic light sensitive material excellent in process stability and a processing method by use thereof.

The present invention can be accomplished by the following means.

(i) A solid developing composition used for a silver halide black-and-white photographic light sensitive material comprising a dihydroxybenzene compound, as a developing agent and further comprising a compound represented by formula (1), $$CH_3(CH_2)_n—(O)_m—SO_3M \qquad \text{formula (1)}$$

wherein n is an integer of 4 to 15; m is 0 or 1; and M is an alkali metal atom, such as Na, K or Li;

(ii) a solid developing composition used for a silver halide black-and-white photographic light sensitive material 1 comprising a compound represented by formula (A), as a developing agent and further comprising a compound represented by formula (1) described above,

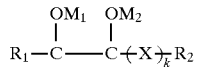

formula (A)

wherein $R_1$ and $R_2$ each are a substituted or unsubstituted alkyl group, substituted or unsubstituted amino group, substituted or unsubstituted alkoxy group or substituted or unsubstituted alkylthio group, and $R_1$ and $R_2$ may be linked with each other to form a ring; k is 0 or 1 and when k is 1, X is —CO— or —CS—; and $M_1$ and $M_2$ each are a hydrogen atom or an alkali metal atom.

DETAILED DESCRIPTION OF THE INVENTION

Explanation regarding formula (1) will be given as below.

$$CH_3(CH_2)_n—(O)_m—SO_3M: \qquad \text{Formula (1)}$$

In formula (1), n is an integer of 4 to 15, preferably, to 9 and more preferably, 6 to 9; m is 0 or 1. M represents alkali metal atom, such as Na, K, Li.

Exemplary examples of the compound represented by formula (1) are shown as below, but the present invention is limited thereto.

| No. | n | m | M |
|---|---|---|---|
| 1-1 | 4 | 0 | Na |
| 1-2 | 4 | 0 | K |
| 1-3 | 4 | 1 | Na |
| 1-4 | 5 | 0 | Na |
| 1-5 | 5 | 0 | K |
| 1-6 | 5 | 1 | Na |
| 1-7 | 6 | 0 | Na |
| 1-8 | 6 | 0 | K |
| 1-9 | 6 | 1 | Na |
| 1-10 | 6 | 0 | K |
| 1-11 | 7 | 0 | Li |
| 1-12 | 7 | 0 | Na |
| 1-13 | 7 | 0 | K |
| 1-14 | 7 | 1 | li |
| 1-15 | 7 | 1 | Na |
| 1-16 | 7 | 1 | K |
| 1-17 | 8 | 0 | Na |
| 1-18 | 8 | 0 | K |
| 1-19 | 8 | 1 | Na |
| 1-20 | 8 | 1 | K |
| 1-21 | 9 | 0 | Na |
| 1-22 | 9 | 1 | Na |
| 1-23 | 9 | 0 | K |
| 1-24 | 9 | 1 | K |
| 1-25 | 10 | 0 | Na |
| 1-26 | 10 | 0 | K |

-continued

| No. | n | m | M |
|---|---|---|---|
| 1-27 | 10 | 1 | K |
| 1-28 | 11 | 0 | Na |
| 1-29 | 11 | 1 | K |
| 1-30 | 12 | 0 | K |
| 1-31 | 12 | 1 | Na |
| 1-32 | 13 | 0 | Na |
| 1-33 | 14 | 0 | Na |
| 1-34 | 15 | 0 | Na |

The compound represented by formula (1) is contained in amount of 0.5 to 50 and preferably 2.5 to 30% by weight of the developing agent used.

In the present invention, the solid developing composition comprises at least one developing agent selected from dihydroxybenzene compounds and compounds represented by the afore-described formula (A).

The dihydroxybenzene compound used in the present invention is preferably a hydroquinone compound represented by the following formula (HQ):

Formula (HQ)

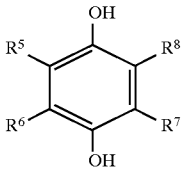

In the formula, $R_5$, $R_6$, $R_7$ and $R_8$ independently represent a hydrogen atom, a halogen atom, an alkyl group, an aryl group, a carboxyl group or sulfo group.

Exemplary compounds represented by formula (HQ) include hydroquinone, chlorohydroquinone, bromohydroquinone, methylhydroquinone, isopropylhydroquinone, 2.5-dimethylhydroquinone, 2,3-dichlorohydroquinone, 2,5-dichlorohydroquinone, and 2,3-dibromohydroquinone.

The dihydroxybenzene compound is contained in a developing solution, in an amount of 0.08 to 0.3 and preferably 0.1 to 0.25 mol per liter of a developing solution. In cases where contained in a solid developing composition, the content of the dihydroxybenzene compound is 8 to 45% by weight and preferably, 10 to 35% by weight of the solid developing composition.

The compound represented by formula (A) will be explained as below.

A compound represented by the following formula (A-a), in which, in the formula (A), $R_1$ and $R_2$ are combined with each other to form a ring, is preferable.

Formula (A-a)

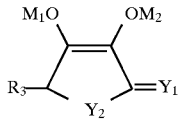

In the formula, $R_3$ is a hydrogen atom, substituted or unsubstituted alkyl group, substituted or unsubstituted aryl group, substituted or unsubstituted amino group, substituted or unsubstituted alkoxy group, sulfo group, carboxy group, amido group or sulfonamido group; $Y_1$ is O or S; $Y_2$ is O, S or $NR_4$, in which $R_4$ is substituted or unsubstituted alkyl group or substituted or unsubstituted aryl group; and $M_1$ and $M_2$ each are a hydrogen atom or alkali metal atom.

As the alkyl group of formula (A) and formula (A-a) is preferred a lower alkyl group, such as an alkyl group having 1 to 5 carbon atoms; the amino group is preferably unsubstituted amino group or amino group substituted by a lower alkoxy group; the alkoxy group is preferably a lower alkoxy group; the aryl group is preferably a phenyl group or naphthyl group; these groups may be substituted and as substituents are cited hydroxy group, halogen atom, alkoxy group, sulfo group, carboxy group, amido group, and sulfonamido group. $M_1$ and $M_2$ each are a hydrogen atom or alkali metal atom, preferably sodium or potassium atom.

Examples of the compound represented by formulas (A) and (A-a) are shown below, but the present invention is not limited thereto.

| Compound No. | X | $R_1$ | $R_2$ | $M_1$ | $M_2$ |
|---|---|---|---|---|---|
| A-1 | — (k = 0) | $HOCH_2-CH(OH)-CH(OH)-$ | $-OH$ | H | H |
| A-2 | — (k = 0) | $CH_3-CH(OH)-CH(OH)-$ | $-OH$ | H | H |
| A-3 | — (k = 0) | $HOCH_2-CH(OH)-CH(OH)-$ | $-CH_3$ | H | H |
| A-4 | — (k = 0) | $CH_3-CH(OH)-CH(OH)-$ | $-CH_3$ | H | H |
| A-5 | $-C(=O)-$ (k = 1) | $HOCH_2-CH(OH)-CH(OH)-$ | $-OH$ | H | H |
| A-6 | $-C(=O)-$ (k = 1) | $CH_3-CH(OH)-CH(OH)-$ | $-OH$ | H | H |
| A-7 | $-C(=S)-$ (k = 1) | $HOCH_2-CH(OH)-CH(OH)-$ | $-OH$ | H | H |

-continued

| Compound No. | X | $R_1$ | $R_2$ | $M_1$ | $M_2$ |
|---|---|---|---|---|---|
| A-8 | $-\overset{\overset{S}{\|\|}}{C}-$ (k = 1) | $CH_3-\underset{\underset{OH}{\|}}{CH}-\underset{\underset{OH}{\|}}{CH}-$ | $-OH$ | H | H |
| A-9 | $-\overset{\overset{O}{\|\|}}{C}-$ (k = 1) | $HO-CH_2-$ | $-OH$ | Na | H |
| A-10 | $-\overset{\overset{O}{\|\|}}{C}-$ (k = 1) | $HO-CH_2-$ | $-CH_3$ | H | H |
| A-11 | $-\overset{\overset{O}{\|\|}}{C}-$ (k = 1) | $HO-CH_2-$ | $-C_2H_5$ | H | H |
| A-12 | $-\overset{\overset{O}{\|\|}}{C}-$ (k = 1) | $HO-CH_2-$ | $-C_2H_4OH$ | H | Na |

| Compound No. | $Y_1$ | $Y_2$ | $R_3$ | $M_1$ | $M_2$ |
|---|---|---|---|---|---|
| A-13 | O | O | H | H | H |
| A-14 | O | O | $CH_3$ | H | H |
| A-15 | O | O | $\underset{\underset{OH}{\|}}{CH_2}$ | H | H |
| A-16 | O | O | $CH_3-\underset{\underset{OH}{\|}}{CH}-$ | H | H |
| A-17 | O | O | $HOCH_2-\underset{\underset{OH}{\|}}{CH}-$ | H | H |
| A-18 | O | O | $HOCH_2-\underset{\underset{OH}{\|}}{CH}-$ | Na | H |
| A-19 | O | O | $HOOCCH_2-\underset{\underset{OH}{\|}}{CH}-$ | H | Na |
| A-20 | S | O | H | Na | H |
| A-21 | S | O | $CH_3-\underset{\underset{OH}{\|}}{CH}-$ | H | H |
| A-22 | S | O | $HOCH_2-\underset{\underset{OH}{\|}}{CH}-$ | H | H |
| A-23 | O | $NCH_3$ | H | H | H |
| A-24 | O | NH | $HOCH_2-\underset{\underset{OH}{\|}}{CH}-$ | H | K |
| A-25 | O | S | H | H | H |
| A-26 | O | S | $HOCH_2-\underset{\underset{OH}{\|}}{CH}-$ | H | H |
| A-27 | O | S | $CH_3-\underset{\underset{OH}{\|}}{CH}-$ | H | H |
| A-28 | S | S | H | H | H |

-continued

| Compound No. | $Y_1$ | $Y_2$ | $R_3$ | $M_1$ | $M_2$ |
|---|---|---|---|---|---|
| A-29 | S | S | $HOCH_2-\underset{\underset{OH}{\|}}{CH}-$ | H | H |
| A-30 | S | S | H | H | H |

These compounds are exemplarily ascorbic acid, erythorbic acid or salts thereof (e.g., sodium, potassium, lithium etc.), derivatives derived therefrom, being commercially available and readily synthesized by a well known method.

The compound represented by formula (A) or (A-a) is contained in a developing solution, in amount of 0.06 to 0.6 and preferably 0.1 to 0.35 mol per liter of a developing solution. In cases where contained in a solid developing composition, the content of the compound is 10 to 90% by weight and preferably, 25 to 75% by weight of the solid developing composition.

The developer or developing composition of the invention preferably contain a compound represented by formula (S). Formula (S):

$$Z^1—SM^1$$

In the formula, $Z^1$ is an alkyl group, an aromatic hydrocarbon group and a heterocyclic group, each of which is substituted by at least one of a hydroxy group, $—SO_3M_1$, $—COOM_1$ ($M_1$ is a hydrogen atom, alkali metal atom or substituted or unsubstituted ammonio ion), a substituted or unsubstituted amino group and a substituted or unsubstituted ammonio group, and these substituent may be further substituted by these substituents. $M^1$ is a hydrogen atom, alkali metal atom, substituted or unsubstituted amidino group, which may form a hydrochloric acid salt or sulfonic acid salt.

In formula (S), the alkyl group represented by $Z^1$ is a straight-chained, branched or cyclic one containing preferably 1 to 30 and more preferably, 2 to 20 carbon atoms, which may be substituted by the above-described substituents and other substituents. The aromatic hydrocarbon group represented by $Z^1$ is preferably a monocyclic or condensed polycyclic one containing 6 to 32 carbon atoms, which may be substituted by the above-described substituent and another substituent. The heterocyclic group represented by $Z^1$ is preferably a monocyclic or condensed polycyclic one containing 1 to 32 carbon atoms (5 or 6-membered ring containing 1 to 6 hetero atoms per ring selected from nitrogen, oxygen and sulfur), each of which may be substituted by the above-described substituent or another substituent. Among the compounds represented by formula (S), a compound having a nitrogen-containing heterocyclic ring, as $Z^1$ is preferred.

In the formula, $Z^1$ is substituted by at least one of a hydroxy group, —$SO_3M_1$, —$COOM_1$ ($M_1$ is a hydrogen atom, alkali metal atom or substituted or unsubstituted ammonio ion), a substituted or unsubstituted amino group and a substituted or unsubstituted ammonio group, and these substituent may be further substituted by these substituents. $M^1$ is a hydrogen atom, alkali metal atom or substituted or unsubstituted amidino group, which may form a hydrochloric acid salt or sulfonic acid salt. The ammonio group may have a substituent having preferably not more than 20 carbon atoms and including a substituted or unsubstituted alkyl group (e.g., methyl, ethyl, benzyl, ethyoxypropyl, cyclohexyl, etc.), or substituted or unsubstituted phenyl group or naphthyl group.

Among the compounds represented by formula (S), a compound represented by the following formula (S-a) is preferred.

Formula (S-a):

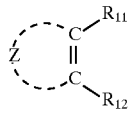

In the formula, Z represents an atom group necessary for forming an unsaturated 5 or 6-membered N-containing heterocyclic ring (e.g., pyrrol, imidazole, pyrazole, pyrimidine, pyridazine, pyrazine etc.). $R^{11}$ and $R^{12}$ each are a hydrogen atom, —$SM^1$ group, a halogen atom, an alkyl group (which may be substituted), an alkoxy group (which may be substituted), hydroxy group, —$COOM^1$, —$SO_3M^1$, an alkenyl group (which may be substituted), a carbamoyl group (which may be substituted) or a phenyl group (which may be substituted), provided that $R^{11}$ and $R^{12}$ may combine to form a ring. The ring is one containing at least one 5 or 6-membered ring, preferably, nitrogen-containing heterocyclic ring. $M^1$ is the same as $M^1$ defined in the above-described formula (S). The compound represented by formula (S-a) has a —$SM^1$ group or a thione group, and a substituent selected from a hydroxyl group, —$COOM^1$, —$SO_3M^1$, substituted or unsubstituted amino group and substituted or unsubstituted ammonio group, each of which may be substituted by a substituent other than the above-described —$SM^1$ group and thione group. The substituent includes a halogen atom (e.g., fluorine, chlorine, bromine, etc.), lower alkyl group having 5 or less carbon atoms (methyl, ethyl, etc.), lower alkoxy group having 5 or less carbon atoms (methoxy, ethoxy butoxy, etc.), lower alkenyl group having 5 or less carbon atoms, carbamoyl group and phenyl group. Further, among the compounds represented by formula (S-a), compounds represented by the following formulas A through F are preferred.

Formula A

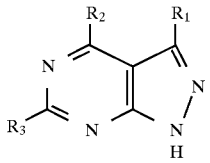

Formula B

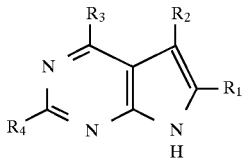

Formula C

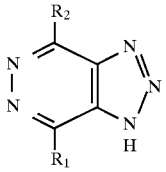

Formula D

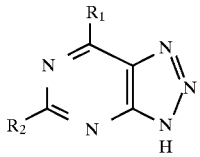

Formula E

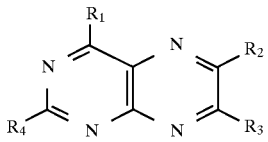

Formula F

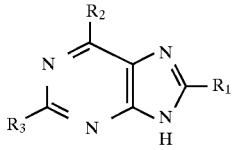

$R_1$, $R_2$, $R_3$ and $R_4$ each are a hydrogen atom, —$SM_1$ group, a halogen atom, a lower alkyl group (preferably, having 5 or less carbon atoms, such as methyl, ethyl), which may be substituted, a lower alkoxy group (preferably, having 5 or less carbon atoms), which may be substituted, hydroxy group, —$COOM_2$, —$SO_3M_3$ group, a lower alkenyl group (preferably, having 5 or less carbon atoms), which may be substituted, an amino group, a carbamoyl group or a phenyl group, provided that at least one of $R_1$, $R_2$, $R_3$ and $R_4$ is —$SM_1$. $M_1$, $M_2$ and $M_3$ each are a hydrogen atom, alkali metal atom or ammonium group. As a substituent other than —$SM_1$ group, a water solubilizing group such as a hydroxy group, —$COOM_2$, $SO_3M_3$ or amino group is preferred. The amino group represented by $R_1$, $R_2$, $R_3$ and $R_4$ may be substituted. As a preferred substituent is cited a lower alkyl group. The ammonium group is substituted or unsubstituted, preferably, unsubstituted one.

Exemplary examples of the compounds represented by formula (S) are shown as below, but the present invention is not limited thereto.

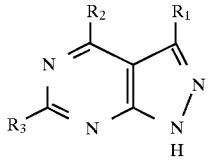

| | $R_1$ | $R_2$ | $R_3$ |
|---|---|---|---|
| S-1 | H | OH | SH |
| S-2 | H | SH | OH |
| S-3 | OH | H | SH |
| S-4 | OH | H | SH |
| S-5 | H | $NH_2$ | SH |
| S-6 | H | SK | $SO_3K$ |
| S-7 | COOH | H | SH |

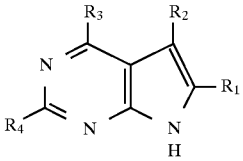

| | $R_1$ | $R_2$ | $R_3$ | $R_4$ |
|---|---|---|---|---|
| S-8 | H | H | OH | SH |
| S-9 | Cl | H | $NH_2$ | SH |
| S-10 | SH | H | $NH_2$ | H |
| S-11 | H | H | COOH | SH |
| S-12 | OH | H | H | SH |
| S-13 | H | H | OH | SH |
| S-14 | SH | H | SH | $SO_3H$ |

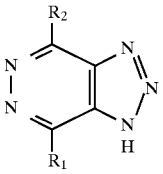

| | $R_1$ | $R_2$ |
|---|---|---|
| S-15 | SH | OH |
| S-16 | $NH_2$ | SH |
| S-17 | SH | COOH |
| S-18 | SH | $SO_3H$ |
| S-19 | SH | OH |

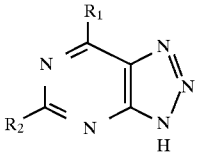

| | $R_1$ | $R_2$ |
|---|---|---|
| S-20 | SH | COOH |
| S-21 | $NH_2$ | SH |
| S-22 | SH | COOH |
| S-23 | SH | $SO_3H$ |
| S-24 | SH | OH |

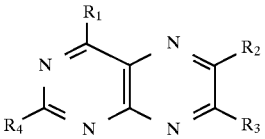

| | $R_1$ | $R_2$ | $R_3$ | $R_4$ |
|---|---|---|---|---|
| S-25 | $NH_2$ | H | H | SH |

-continued

| | | | | |
|---|---|---|---|---|
| S-26 | COOH | H | SH | SH |
| S-27 | OH | H | H | SH |
| S-28 | H | $NH_2$ | H | SH |
| S-29 | SH | COOH | H | H |
| S-30 | H | H | $SO_3H$ | SH |

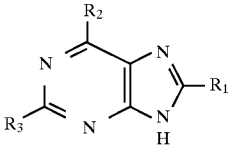

| | $R_1$ | $R_2$ | $R_3$ |
|---|---|---|---|
| S-31 | SH | OH | H |
| S-32 | SH | H | COOH |
| S-33 | H | OH | SH |
| S-34 | $SO_3H$ | SH | SH |
| S-35 | H | SH | $SO_3H$ |
| S-36 | $NH_2$ | H | SH |
| S-37 | $NH_2$ | SH | H |
| S-38 | H | $NH_2$ | SNa |
| S-39 | SH | $NH_2$ | H |

The compound represented by formula (S) is contained in an amount of $10^{-6}$ to $10^{-1}$, preferably, $10^{-5}$ to $10^{-2}$ mol per liter of developing solution. In cases where contained in the solid developing composition, the compound of formula (S) is contained in an amount of 0.01 to 1% by weight.

A photographic light sensitive material which may be processed with the developer of the invention will be explained as below. The photographic material preferably contains a hydrazine compound, from the point of enhancement of effects of the invention.

In the invention, the hydrazine compound is preferably represented by the following formula (H).

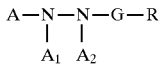

Formula (H)

In the formula, A represents an aryl group or a heterocyclic group containing therein at least one sulfur atom or an oxygen atom; G represents a —(CO)n— group, a sulfonyl group, a sulfoxy group, a —P(=O)$R_2$ group or an iminomethylene group, in which n represents an integer of 1 or 2; $A_1$ or $A_2$ both represent hydrogen atoms, or one of $A_1$ and $A_2$ represents a hydrogen atom and the other one represents a substituted or unsubstituted alkylsulfonyl group or a substituted or unsubstituted acyl group; R represents a hydrogen atom, or respectively a substituted or an unsubstituted alkyl group, alkenyl group, aryl group, alkoxy group, alkenyloxy group, aryloxy group, heterocyclic oxy group, amino group, carbamoyl group or oxycarbonyl group; and $R_2$ represents respectively a substituted or an unsubstituted alkyl group, alkenyl group, alkinyl group, aryl group, alkoxy group, alkenyloxy group, alkinyloxy group, aryloxy group, amino group, etc.

Among the compounds represented by formula (H), a compound represented by the following formula (Ha) is more preferred.

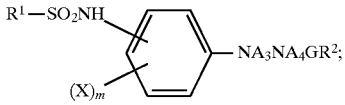

Formula (Ha)

In the formula, $R^1$ represents an aliphatic group, for example, octyl group, decyl group, etc,; an aromatic hydrocarbon group, for example, phenyl group, 2-hydroxylphenyl group, chlorophenyl group, etc.; or a heterocyclic group, for example, a pyridyl group, a thienyl group, a furyl group, etc.; and these groups may preferably be substituted by an appropriate substituent. Further, it is also preferable that $R^1$ contains at least one ballast group or a group for accelerating adsorption onto silver halide.

As a diffusion-proof group, the ballast groups which are commonly used in the immobile photographic additives such as couplers are preferable, and for such ballast groups, for example, an alkyl group, an alkenyl group, an alkinyl group, an alkoxy group, a phenyl group, a phenoxy group, an alkylphenoxy group, etc., which are relatively inert photographically, can be mentioned.

As the silver halide adsorption-accelerating agent, for example, a thiourea group, a thiourethane group, a mercapto group, a thioether group, a thione group, a heterocyclic group, a thioamide heterocyclic group, mercapto heterocyclic group, or those adsorption-accelerating groups disclosed inb Japanese Patent O,P.I. Publication No.64-90439(1989), etc. can be cited.

In the general formula Ha, X represents a group which is capable of being a substituent for a phenyl group, m represents an integer of zero through four, provided when m is two or more, X may be either the same or different.

In formula (Ha), $A_3$ and $A_4$ independently have the same definition as that of $A_1$ and $A_2$, respectively and both of them are hydrogen atoms.

In the general formula Ha, G represents a carbonyl group, a sulfonyl group, a sulfoxy group, a phosphoryl group or an iminomethylene group, and carbonyl group is preferable as G.

In formula (Ha), $R^2$ represents a hydrogen atom, an alkyl group, an alkenyl group, an alkinyl group, an aryl group, a heterocyclic group, an alkoxy group, a hydroxy group, an amino group, a carbamoyl group, a —CON($R^4$) ($R^5$) group, etc. can be mentioned. ($R^3$ represents an alkinyl group or a saturated heterocyclic group; $R^4$ represents a hydrogen atom, an alkyl group, an alkenyl group, an alkinyl group, an aryl group or a heterocyclic group; and $R^5$ represents an alkenyl group, an alkinyl group, a saturated heterocyclic group,a hydroxy group or an alkoxy group.

Exemplary examples of the compound represented by the general formula (H) are given below; however, the scope of the present invention is not limited by these.

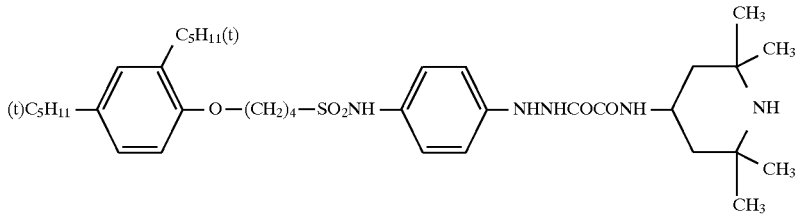

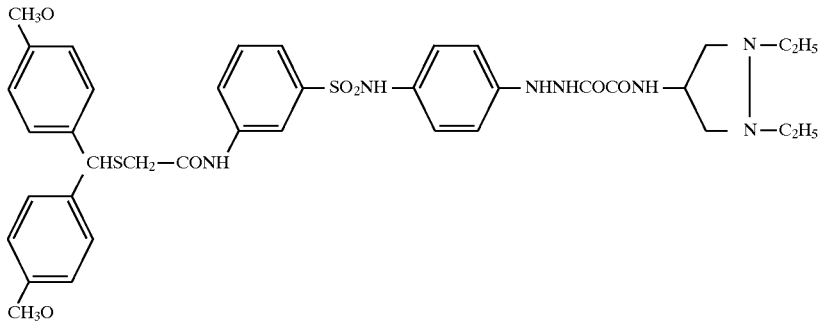

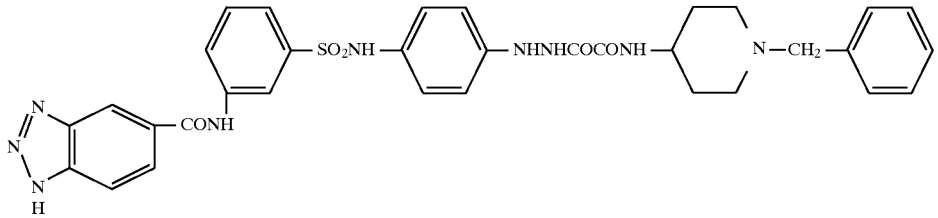

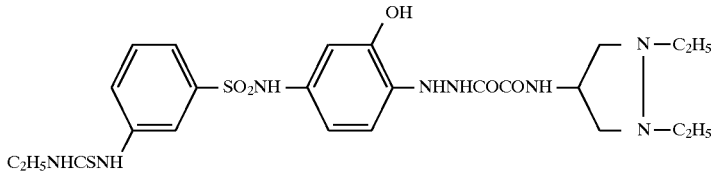

-continued
H-5
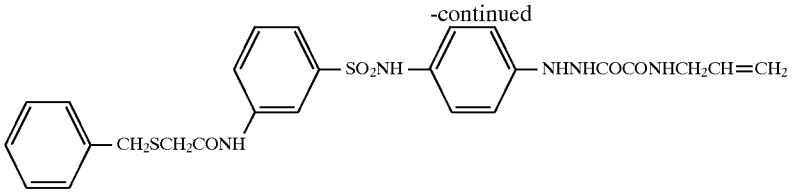
H-6
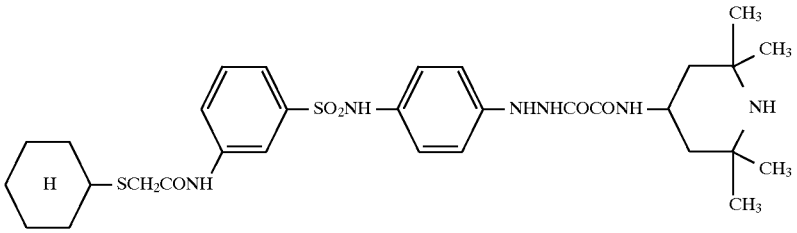
H-7
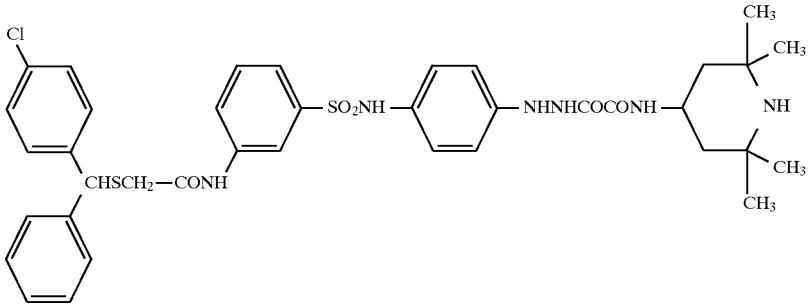
H-8
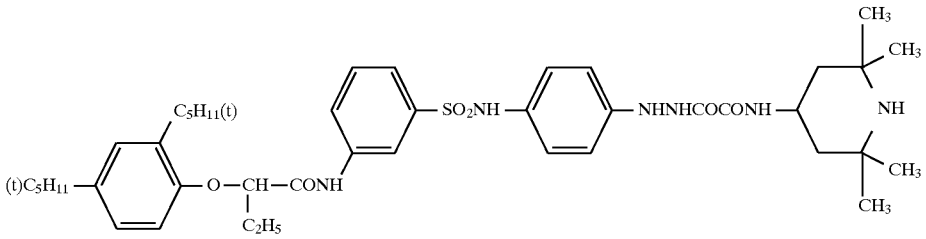
H-9
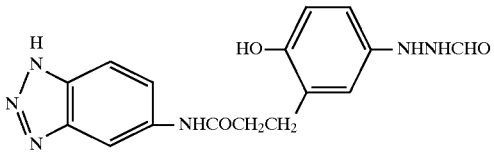
H-10
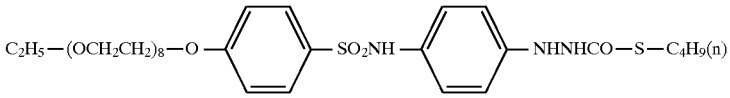
H-11
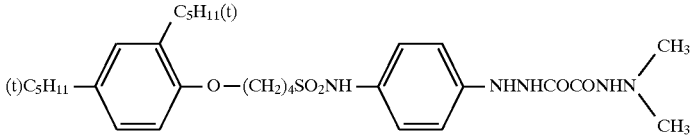
H-12
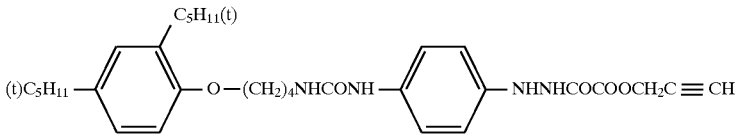
H-13
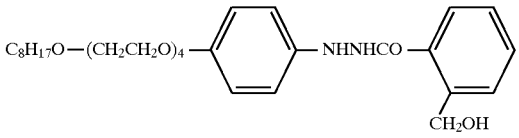

-continued
H-14
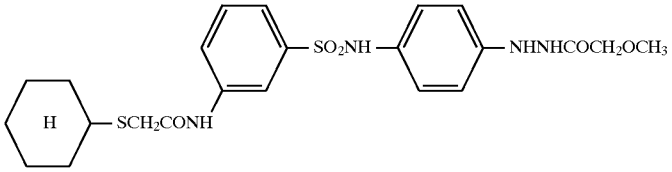
H-15
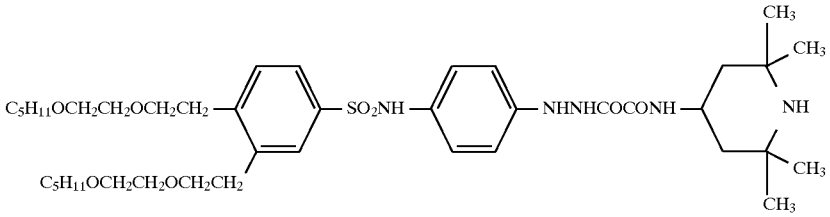
H-16
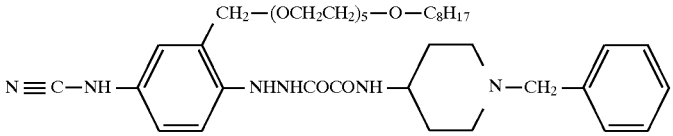
H-17
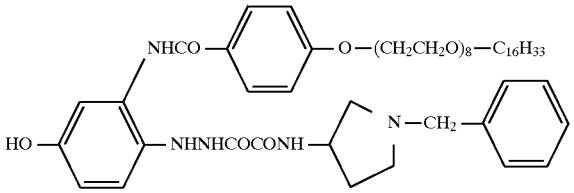
H-18
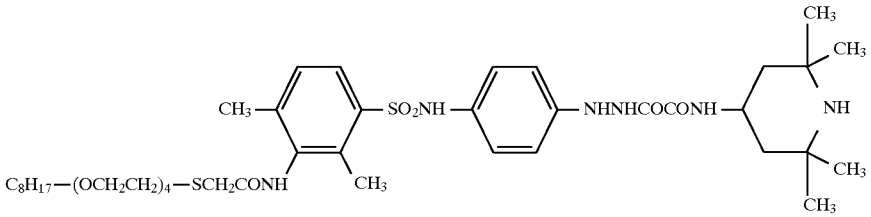
H-19
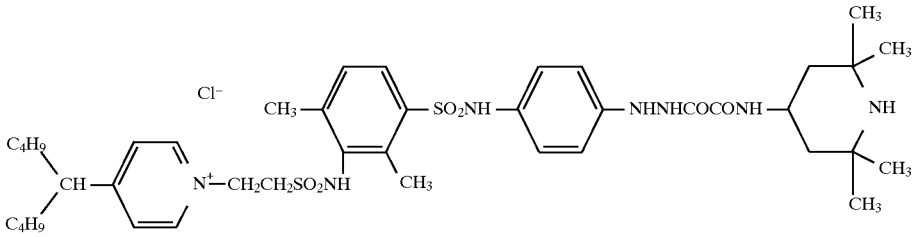
H-20
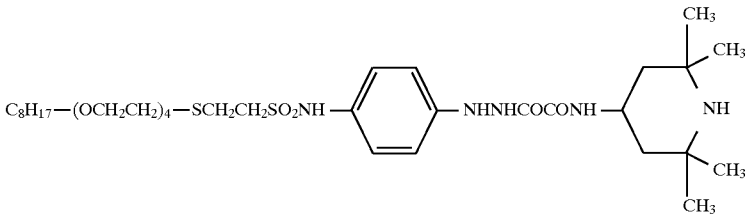
H-21
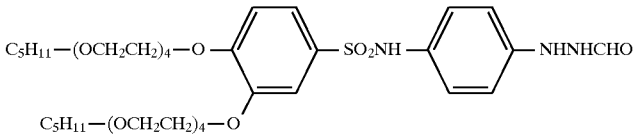

-continued

H-22

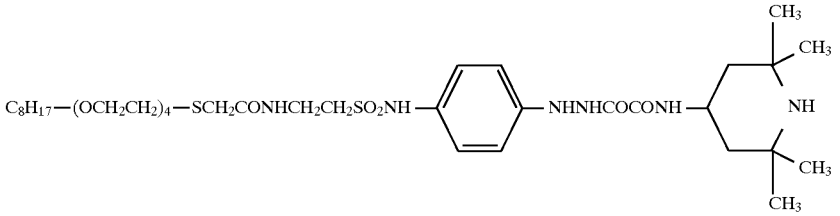

H-23

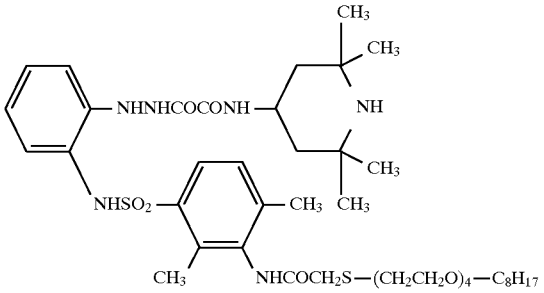

H-24

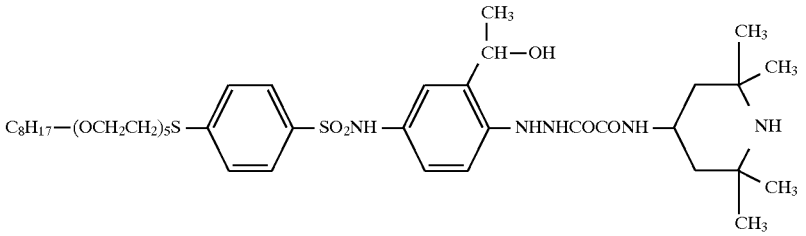

H-25

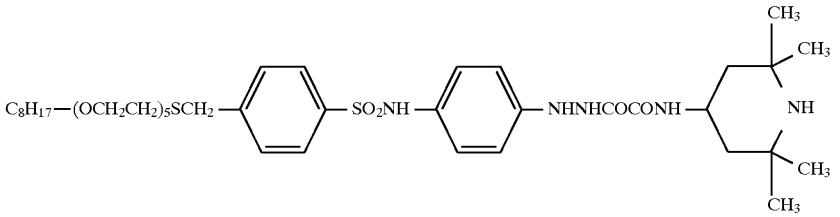

As other specifix examples of hydrazine compounds, for example, those Exemplified Compounds(1) through (252 disclosed on columns 4 through 60 of U.S. Pat. No. 5,229,248 can be mentioned.

The hydrazine compounds according to the present invention can be synthesized according to the conventionally known methods in the art. For example, they may be synthesized according to the method disclosed on columns 59 through 80 in the U.S. Pat. No. 5,229,248.

An adding amount of the hydrazine derivative may be optional if it is one capable of hardening the light-sensitive photographic material according to the present invention, and the optimum amount of addition may be varied depending on the grain size of the silver halide particles, halide composition, degree of chemical ripening and kind of restraining agent, etc., however, it is generally between $10^{-6}$ and $10^{-1}$ mol, and, more preferably, between $10^{-6}$ and $10^{-2}$ mol per one mol of silver halide. The hydrazine compound used in the present invention is incorporated preferably either in the silver halide emulsion layer or a layer adjacent thereto.

In order to accelerate the contrast-increasing effect of the hydrazine compound, it is preferable to use a nucleation accelerator represented by the following general formula (Na) or (Nb).

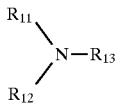

Formula [Na]

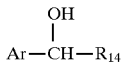

Formula [Nb]

In the Formula (Na), $R_{11}$,$R_{12}$ and $R_{13}$ independently represent a hydrogen atom, a substituted or unsubstituted alkyl group, a substituted or unsubstituted alkenyl group, an alkinyl group, a substituted or unsubstituted aryl group, provided that $R_{11}$, $R_{12}$ and $R_{13}$ may combine to form a ring. Among these compounds represented by formula (Na), is particularly preferable an aliphatic tertiary amine compound. It is preferable for these compounds to contain in their molecules an diffusion-proof group or a silver halide adsorption-accelerating group. In order for the diffusion-proof property to be conferred, a compound having molecular weight more than 100 is preferable, and, more advantageously, one having a molecular weight of not less than 300. Moreover as preferable adsorption-accelerating groups, for example, a heterocyclic group, a mercapto group, a thioether group, a thion group, thiourea group, etc. can be mentioned. As particularly preferable compound represented by the general formula (Na), a compound having in its molecule at least one thioether group as the silver halide adsorption-accelerating group can be mentioned.

Below, exemplary nucleation accelerators represented by the formula (Na) are given below.

Na-1

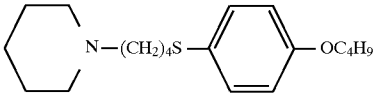

Na-2

$[(C_3H_7)_2N(CH_2)_3OCH_2CH_2]_2S$

Na-3

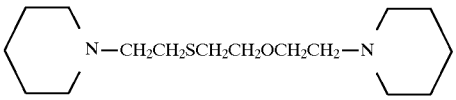

Na-4

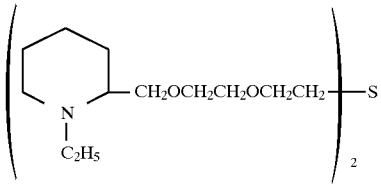

Na-5

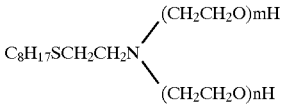

Na-6

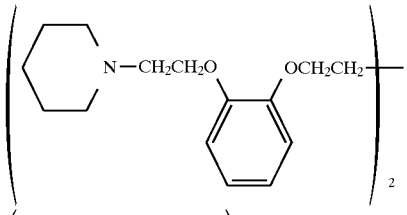

Na-7

Na-8

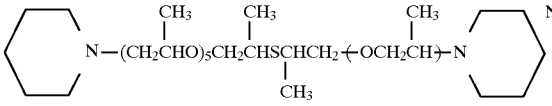

Na-9

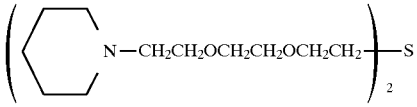

Na-10

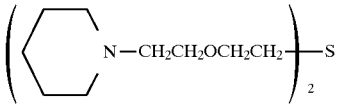

Na-11

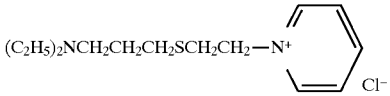

Na-12

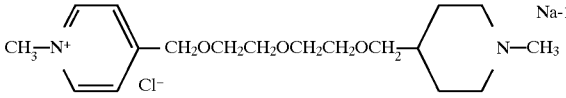

Na-13

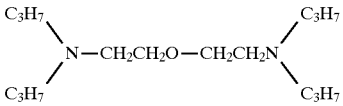

Na-14

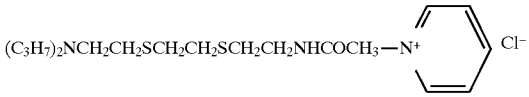

-continued

Na-15

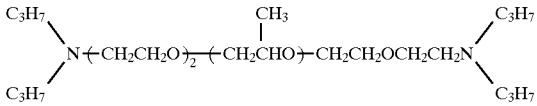

Na-16

$((C_2H_5)_2N(CH_2)_3NHCOCH_2)_2Se$

Na-17

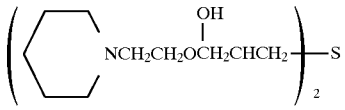

Na-18

$(C_2H_5)_2NCH_2CH_2(OCHCH_2)_7SCH_2CH_2N(C_2H_5)_2$

Na-19

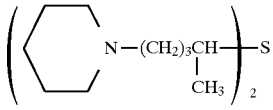

Na-20

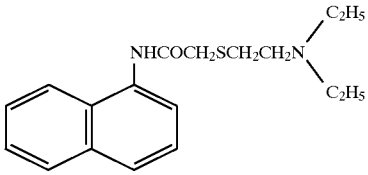

In the formula (Nb), Ar represents a substituted or unsubstituted aromatic group or heterocyclic group. $R_{14}$ represents a hydrogen atom, an alkyl group, an alkenyl group, an alkynyl group, or an aryl group, provided that Ar and $R_{14}$ may combine to form a ring. These compounds preferably contain in their molecules an diffusion-proof group or a group for accelerating adsorption onto silver halidep. The molecular weight to confer diffusion-proof property on the compound is 120 or more, and, more preferably, more than 300. Further, as a preferable adsorption-accelerating group, the same group defined as the adsorption accelerating group in the General Formula H can be cited.

Exemplary compounds represented by the formula (Nb) are given below.

Nb-1

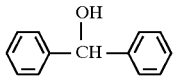

Nb-2

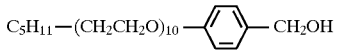

Nb-3

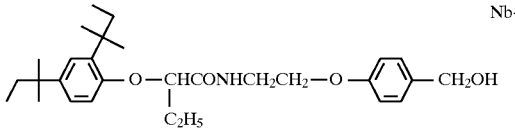

Nb-4

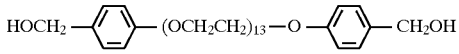

Nb-5

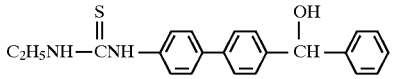

Nb-6

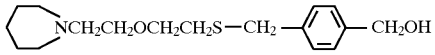

-continued

Nb-7

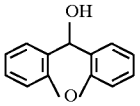

Nb-8

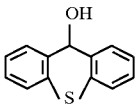

Nb-9

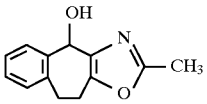

Nb-10

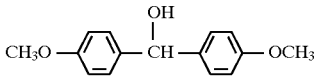

Nb-11

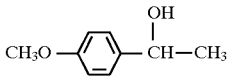

Nb-12

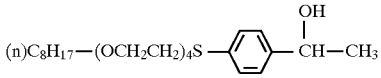

Exemplary examples of the nucleation accelerators include, for example, Exemplified Compounds (2-1) through (2-20) disclosed in paragraphs (0062) on Page 13 through (0065) (page 15) in Japanese Patent O>P>I> Publication No.6-258751(1994) and Exemplified Compounds 3-1~3-6 disclosed in paragraphs (0067) on page 15 through (0068) on page 16 in Japanese Patent OPI Publication No.6-258751(1994).

These nucleation accelerators may be used in any layer provided on the side of the silver halide emulsion layer. Preferably, the compound is incorporated either in the silver halide emulsion layer or a layer located adjacent thereto.

In the present invention, a silver halide emulsion layer or a hydrophilic colloidal layer contains at least one compound represented by formula (T) below. Below, the compound represented by the formula (T) is explained.

Formula (T)

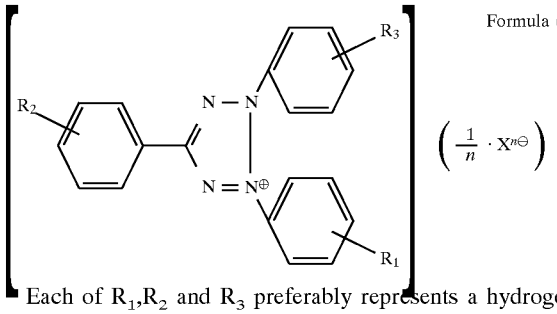

Each of $R_1$,$R_2$ and $R_3$ preferably represents a hydrogen atom or a group, of which Hammett's σ-value showing degree of electron attraction is negative.

The σ values of the phenyl substitution are disclosed in lots of reference books. For example, a report by C. Hansch in "The Journal of Medical Chemistry", vol.20, on page 304(1977), etc. can be mentioned. Groups showing particularly preferable negative σ-values include, for example, methyl group ($\sigma_p$=−0.17, and in the following, values in the are in terms of $\sigma_p$ value), ethyl group(−0.15), cyclopropyl group(−0.21), n-propyl group(−0.13), iso-propyl group(−0.15), cyclobutyl group(−0.15), n-butyl group(−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the general formula T according to the present invention.

n represents 1 or 2, and as anions represented by $x^{n-}$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, specifically including lower alkyl benzenesulfonic acid anions such as p-toluenesulfonic anion, etc.; alkylbenzene sulfonic acid anions such as p-dodecyl benzenesulfonic acid anion, etc.; higher alkyl sulfate anions such as lauryl sulfate anion, etc.; Boric acid-type anions such as tetraphenyl boron, etc.; succinate anions such as di-2-ethylhexylsulfo succinate anion, etc.; sulfate anions such as cetyl polyethenoxy sulfate anion, etc.; higher aliphatic acid anions such as stearic acid anion, etc.; and those in which an anionic radical is attached to a polymer, such as polyacrylic acid anion, etc. can be mentioned.

Specific exemplified compounds represented by the formula (T) are given, However, the scope of the present invention is not limited by these tetrazolium compounds.

| Compound | $R_1$ | $R_2$ | $R_3$ | $X_T^{nT-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_2$ | $Cl^-$ |
| T-6 | p-$CCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | P-$NH_2$ | H | $Cl^-$ |
| T-17 | P-$NH_2$ | H | H | $Cl^-$ |
| T-18 | p-$CH_3$ | H | p-$CH_3$ | $ClO_4^-$ |

The above-mentioned tetrazolium compounds can be synthesized according to the method described in Chem. Rev. Vol 55, pages 335–483. The tetrazolium compound may be added singly or in combination thereof.

The hydrazine compound, nucleation accelerator or tetrazolium compound used in the invention may be added any of layers provided in the photographic material, preferably, in a silver halide emulsion layer or adjacent layer thereto. The addition amount, which is dependent of the grain size, halide composition and degree of chemical sensitization of silver halide and kind of a restraining agent, is a range of $10^{-6}$ to $10^{-1}$, preferably, $10^{-5}$ to $10^{-2}$ mol per mol of silver halide.

Next, in a silver halide photographic light sensitive material relating to the invention are preferably incorporated a pyridinium compounds, quinolinium compounds, and isoquinolinium compounds (hereinafter, these compounds are generally referred to as pyridinium derivatives). Specifically, addition of the pyridinium compounds enhances the inventive effects.

The pyridinium derivatives usable in the invention include pyridinium compounds represented by formula (N-I), quinolinium compounds represented by the following formula (N-II), and isoquinolinium compounds represented by formula (N-III)

Formula (N-I)

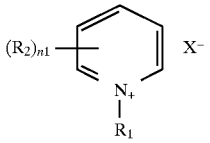

In formula (N–1), $R_1$ is an amino group, alkyl-substituted amino group (e.g., N-methylamino, N,N-dimethylamino, etc.), aromatic hydrocarbon group, such as phenyl or pyridyl or —A—Z, in which A is an alkyl group having 1 to 20 carbon atoms or —$CH_2CH{=}CHCH_2$—, Z is a hydrogen atom, phenyl group (which may be substituted), hydroxy group, alkoxy group such as methoxy or ethoxy, acyl group such as acetyl or benzoyl, alkoxycarbonyl group such as methoxycarbonyl or ethoxycarbonyl, cyano group, N-alkylamido group, amido group, or a group represented by the following formula (N-Ia).

Formula (N-Ia)

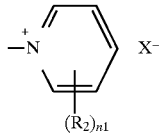

In formulas (N–1) and (N–1a), $R_2$ is a lower alkyl group (methyl group, ethyl group, propyl group, butyl group, etc.), hydroxy group, alkoxy group, a lower alkyl group substituted by an aromatic group such as phenyl or pyridyl group (2-hydroxyethyl, 3-hydroxypropyl, 2-methoxyethyl, 4-ethoxybutyl, benzyl, 2-ethylphenyl, 3-(4-pyridyl)propyl, etc.), amido group (=$CONH_2$, —$NHSO_2C_5H_{11}$, —$NHSO_2Ph$, etc.); and $n_1$ is an integer of 0, 1, 2 and 3, provided that, when $R_2$ is plural, they may be different from each other. $X^-$ is an anion such as iodide ion, bromide ion, chloride ion, p-toluenesulfonate ion, perchlorate ion, or methysulfate ion, provided that, when formula (N-I) is betaine structure, X is not present.

Formula (N-II)

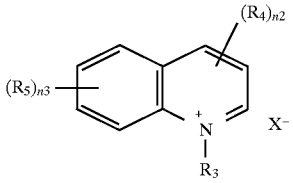

In formula (N–2), $R_3$ is a substituted or unsubstituted lower alkyl group, alkyl group or alkynyl group. As a preferred substituent are cited a hydroxy group; lower alkoxy group such as methoxy or ethoxy; aromatic hydrocarbon group such as phenyl; acyl group such as acetyl or benzoyl; alkoxycarbonyl group such as methoxycarbonyl or ethoxycarbonyl; amido group or cyano group. Examples of $R_3$ include methyl, ethyl, n-propyl, isopropyl, n-butyl, isobutyl, pentyl, 2-hydroxypropyl, 3-hydroxypropyl, 2-methoxypropyl, 3-ethylpropyl, 2-phenylethyl, 3-acetylpropyl, 2-benzoylethyl, 2-methoxycarbonylethyl, 2-cyanoethyl, 2-carbamoylethyl, butenyl, propargyl, benzyl, toluyl and phenethyl. $R_4$ and $R_5$ independently are a halogen atom, lower alkyl group (e.g., methyl, ethyl, n-propyl, isopropyl, n-butyl, isobutyl, pentyl, etc.), substituted lower alkyl group or alkoxy group (e.g., methoxy, ethoxy, etc.). As a substituent of the substituted alkyl group are preferably a hydroxy group, lower alkoxy group, and substituted or unsubstituted aromatic hydrocarbon group (e.g., phenyl, alkyl-substituted phenyl, etc.). Examples of the substituted lower alkyl group include hydroxymethyl, 2-hydroxyethyl, 3-hydroxypropyl, 2-methoxyethyl, 2-ethoxyethyl, benzyl, 2-phenylethyl and 2-tolylethyl. $n_2$ and $n_3$ each are 0 or 2. When $R_4$ and/or $R_5$ are plural number, they may be different from each other or may form a ring between them (e.g., 5-membered ring, 6-membered ring and 7-membered ring). $X^{31}$ is an anion such as iodide ion, bromide ion, chloride ion, p-toluenesulfonate ion, perchlorate ion, or methysulfate ion, provided that, when formula (N-II) is betaine structure, X is not present.

Formula (N-III)

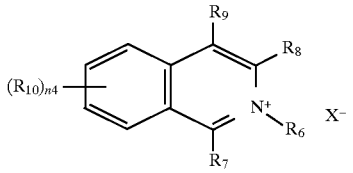

In the formula, $R_6$ is an alkyl group (e.g., methyl, ethyl, propyl, butyl, pentyl etc.) or substituted alkyl group. $R_6$ and $R_8$ may combine together with each other to form a 6-membered or 5-membered ring. $R_7$ is a hydrogen atom, lower alkyl group (e.g., methyl, ethyl, propyl, butyl, pentyl, etc.), substituted alkyl or aryl )e.g., phenyl, alkyl-substituted phenyl, etc.). As a substituent of the substituted alkyl group of $R_6$ and $R_7$ are cited hydroxy group, alkoxy group (e.g., methoxy, ethoxy, etc.), aryl group (e.g., phenyl, alkyl-substituted phenyl, etc.). Examples of the substituted alkyl group include 2-hydroxyethyl, 3-hydroxypropyl, 2-methoxyethyl, 2-ethoxyethyl, benzyl, 2-phenylethyl. $R_8$ and $R_9$ each are a hydrogen atom, lower alkyl group, )e.g., methyl, ethyl, propyl, etc.), hydroxy group, lower alkyl group substituted by a group such as alkoxy (e.g., 2-hydroxyethyl, 3-hydroxypropyl, 2-methoxyethyl, 2-ethoxypropyl, etc.) or amido group. $R_8$ and $R_9$ may combine together to form a 5-membered or 6-membered ring or aromatic ring. $R_{10}$ is a hydrogen atom, (e.g., chlorine atom, bromine atom, etc.), lower alkyl group, which may be substituted (methyl, ethyl, propyl, 2-hydroxyethyl, 3-hydroxypropyl, 2-methoxyethyl, benzyl, etc.), alkoxy group (e.g., methoxy, ethoxy, etc.) or amino group, which may be substituted by an alkyl group. $n_4$ is 0, 1 or 2. When $R_{10}$ is plural, they may be different with each other. $X^-$ is an anion such as iodide ion, bromide ion, chloride ion, p-toluenesulfonate ion, perchlorate ion, or methysulfate ion, provided that, when formula (N–2) is betaine structure, X is not present.

The pyridinium derivatives used in a silver halide photographic material relating to the invention each have a reduction potential of –0.60 V or less, preferably, –0.80 V or less. The reduction potential (Rred) means a potential at which the pyridinium derivatives are subjected to electron-injection at cathode to be reduces, in voltantometry. The reduction potential (Ered) can be accurately determined in voltantometry. Thus, a voltamogram of the pyridinium derivatives of $1\times10^{-4}$ to $1\times10^{-3}$ mol is measured in acetonitrile containing 0.1 mol of tetra-n-butylammonium perchlorate as supporting electrolyte, from which a half-wave potential is obtained. In this case, there are employed platinum as a working electrode and saturated calomel electrode (SCE) as a reference electrode at 25° C. Further details thereof are referred to U.S. Pat. No. 3,501,307 and P. Delahay, "New Instrumental Methods in Electrochemistry" (Interscience Publisher, 1954).

Examples of the pyridinium derivatives usable in the invention are shown below, but the invention is not limited thereto.

N-1
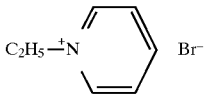
N-2
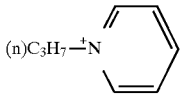
N-3
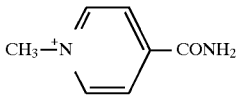
N-4
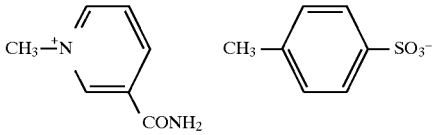
N-5
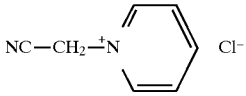
N-6
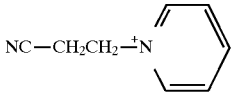
N-7
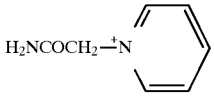
N-8
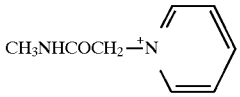
N-9
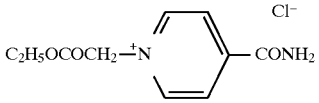
N-10
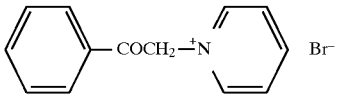
N-11
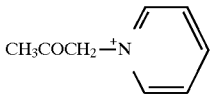
N-12
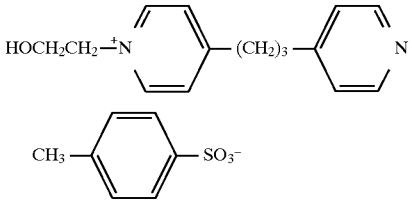
N-13
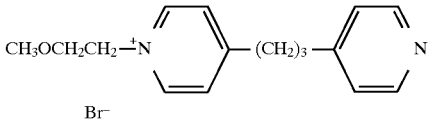
-continued
N-14
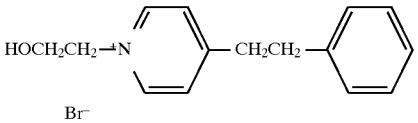
N-15
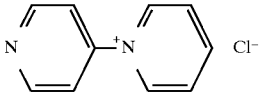
N-16
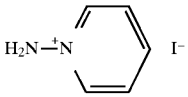
N-17
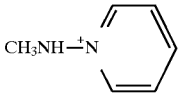
N-18
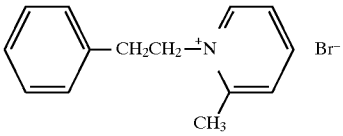
N-19
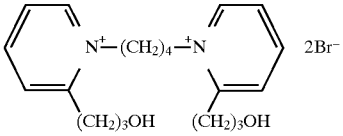
N-20
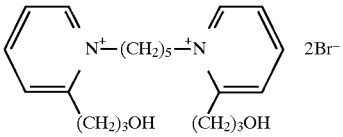
N-21
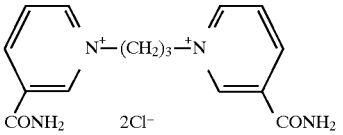
N-22
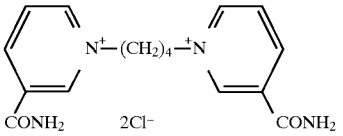
N-23
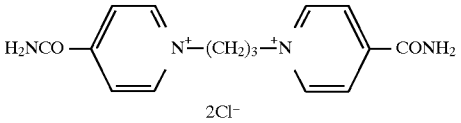
N-24
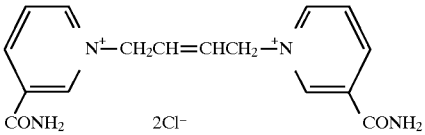
N-25
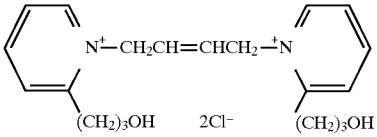

-continued
N-26
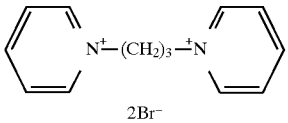
N-27
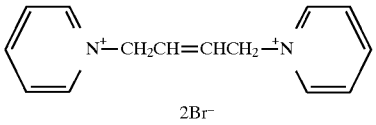
N-28
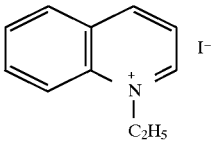
N-29
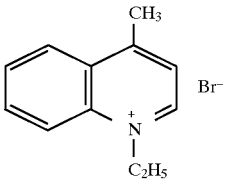
N-30
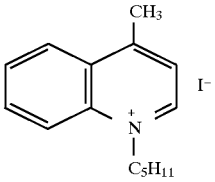
N-31
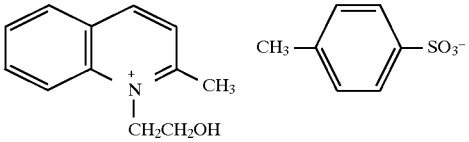
N-32
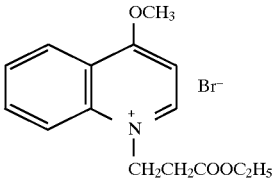
N-33
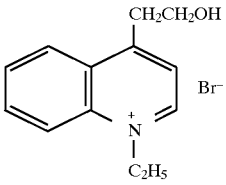
N-34
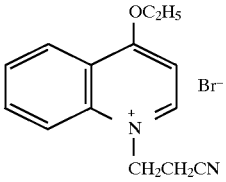
-continued
N-35
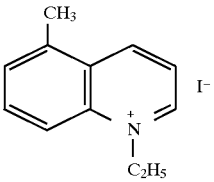
N-36
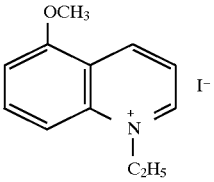
N-37
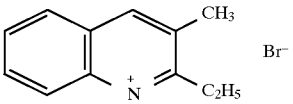
N-38
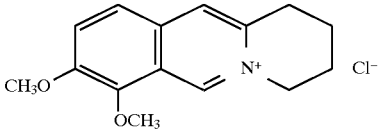
N-39
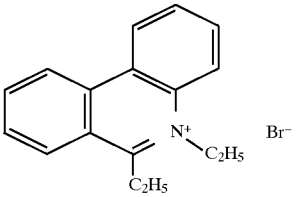
N-40
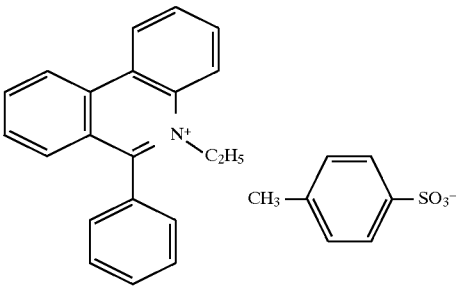
N-41
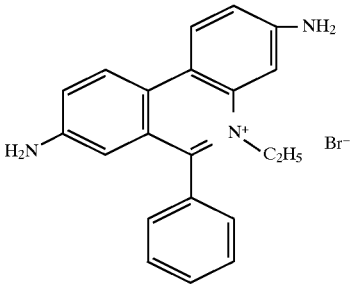

-continued
N-42
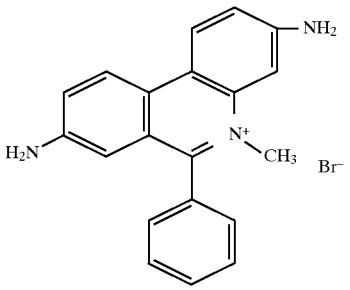
N-43
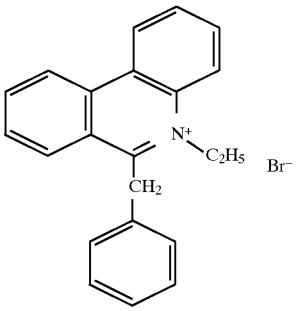
N-44
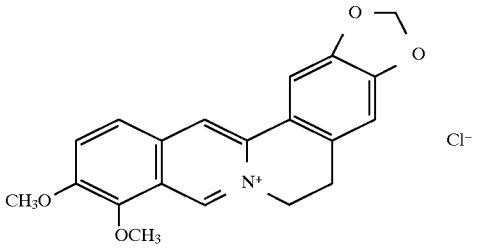
N-45
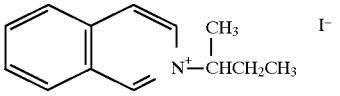
N-46
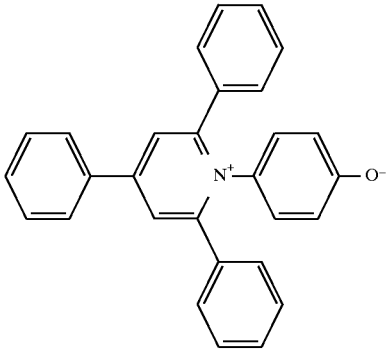
N-47
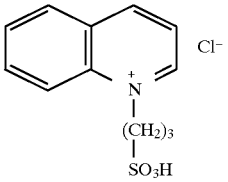
-continued
N-48
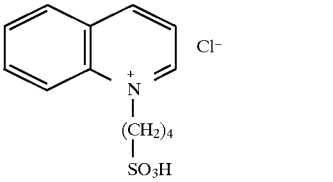
N-49
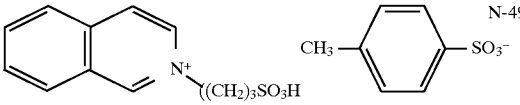
N-50
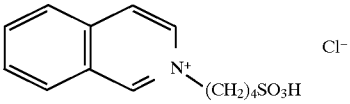
N-51
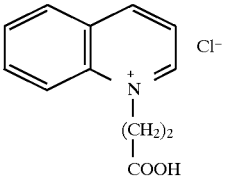
N-52
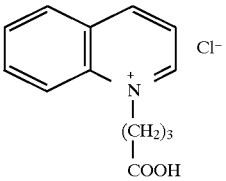
N-53
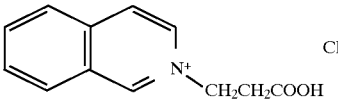
N-54
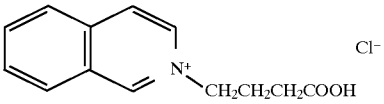
N-55
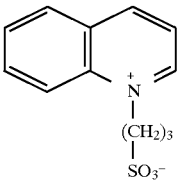
N-56
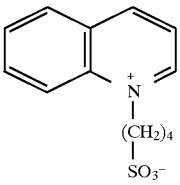
N-57
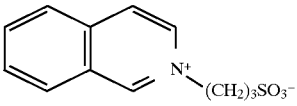
N-58
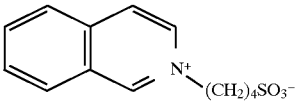

-continued
N-59
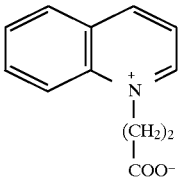
N-60
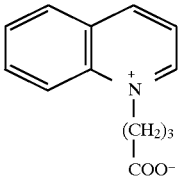
N-61
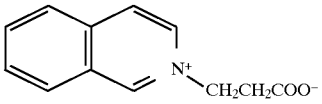
N-62
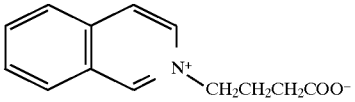
N-63
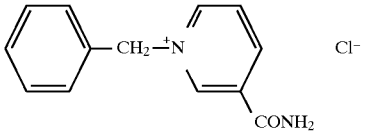
N-64
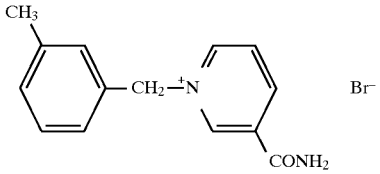
N-65
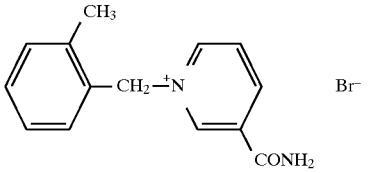
N-66
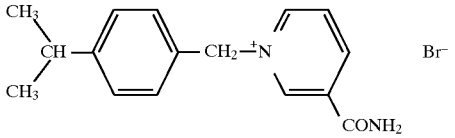
N-67
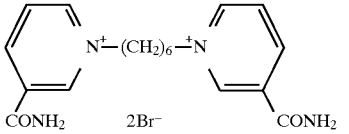
N-68
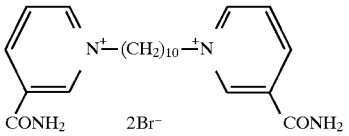
-continued
N-69
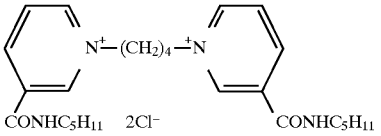
N-70
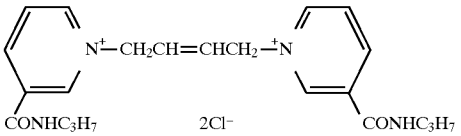
N-71
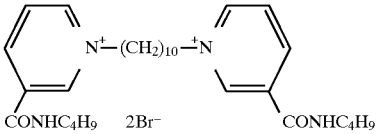
N-72
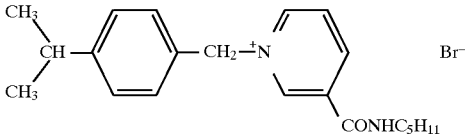
N-73
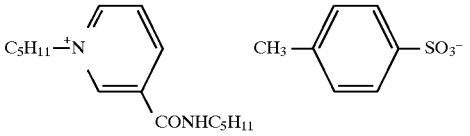
N-74
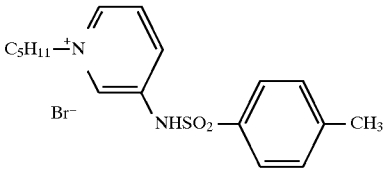
N-75
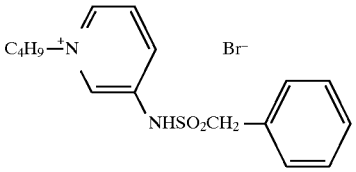
N-76
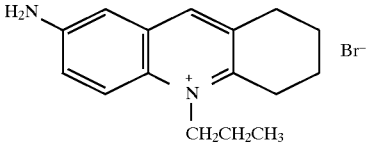
N-77
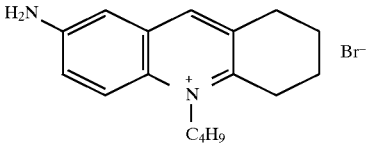
N-78
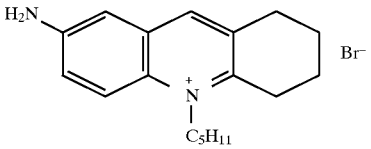

-continued

N-79

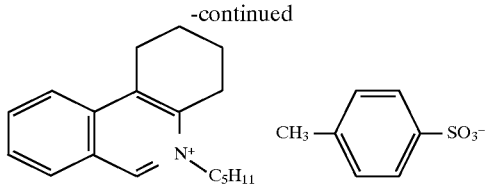

N-80

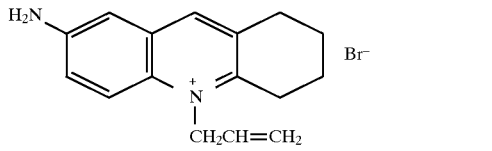

The pyridinium derivatives can be synthesized through the reaction of a corresponding pyridine, quinoline or isoquinoline derivatives with an alkyl halide, as described in M. Odake, "Organic Chemistry" vol. 16, page 7 and 129 (1959, Asakura Shoten). Examples thereof are described in A. G. E. Renk, Helv. Chim. Acta 37, 1672 (1954); R. E. Lyle, E. F. Perlowski, H. J. Troscianiec, G. G. Lyle, J. Chem. 20, 1761 (1955); M. R. Lamborg, R. M. Burton, N. O. Kaplan, J. Am. Chem. Soc. 79, 6173 (1957); W. Ciusa, A. buccelli, Gazzetta Chimia Italiana 88, 393 (1958).

The pyridinium derivatives may be incorporated in a silver halide emulsion layer or another light-insensitive hydrophilic colloidal layer, such as protective layer, interlayer, antihalation layer or filter layer The pyridinium derivatives are incorporated in an amount of $1\times10^{-6}$ to 1 mol per mol of silver halide, preferably, $1\times10^{-4}$ to 0.1 mol per mol of silver halide. The pyridinium compound may be incorporated in combination thereof. The pyridinium compound is dissolved in water or water-miscible solvent such as alcohols, ketones, esters or amides. The pyridinium compound may be added in an emulsion layer or another light-insensitive layer at any time during the course of preparing a silver halide photographic material. For example, the addition to the emulsion may be made at a time from the start of chemical ripening to the time prior to coating.

Although functional mechanism of the pyridinium derivatives used in the invention has not been clarified definitely, it is contemplated that, in development with an alkaline developer, the pyridinium derivative undergoes nucleation reaction and plays a role as a contrast-increasing agent which achieves enhanced sensitivity and contrast. Such enhancements in sensitivity and contrast by the pyridinium salt derivative have not been known and unexpected.

Processing composition used in the invention will be explained as below. The processing composition may be supplied in any form of powder, paste, granules, a tablet, concentrated solution and working solution. The processing composition is preferably supplied in the form of granules, a tablet or concentrated solution and more preferably in the form of granules or a tablet. In this case, a starting solution is prepared by dissolving the processing composition in water according to the specified manner. In the case when used for a replenishing solution, the processing composition may be previously dissolved in water or directly supplied to the processor.

Sulfites and metabisulfites used as a preserver in a developing solution used in the invention include sodium sulfite, potassium sulfite, ammonium sulfite and sodium metabisulfite. The sulfite is contained preferably in an amount of 0.25 mol/l or more and more preferably, 0.4 mol/l or more.

To the developing solution may optionally be added various additives including, for example, an alkali agents such as sodium hydroxide, potassium hydroxide,etc,; pH buffers such as carbonates, phosphates, borates, boric acid acetic acid, citric acid, alkanolamine, etc,; solubilization aids such as polyethylene glycols, esters thereof, alkanolamine, etc.; sensitizers such as nonionic surface active agents containing a polyoxyethylene, quaternary ammonium compounds, etc.; surface active agents, antifoaming agents, anti-foggants such as halide compounds such as potassium bromide, sodium bromide, etc.; nitrobenzindazole, nitrobenzimidazole, benztriazole, benzthiazole, tetrazole compounds, thiazole compounds, etc.; chelating agents such as ethylenediaminetetraacetic acid or alkali salts thereof, nitrilotriacetic acid, polyphosphonic acids, etc.; development accelerators such as those compounds disclosed in the U.S. Pat. No. 2,304,025, Japanese Patent Publication No.47-45541(1972), etc,; hardening agents such as glutal aldehyde or metasulfite additives thereof, etc.; anti-foaming agents, etc. may the pH of the developing solution is preferably adjusted not less than 7.5 and less than 10.5. More preferably the pH is adjusted not less than 8.5 and less than 10.4.

Waste developer solution may be regenerated by electric energization. Specifically, an anode, for example, an electric conductor such as stainless wool, or a semi-conductor is put in the waste developing solution, and a cathode, for example, an insoluble conductor such as carbon, gold, platinum, titanium, etc. is put in an electrolyte solution, and the waste developer bath and the electrolyte bath are brought into contact through an anion exchange membrane, and electricity is applied to both electrodes to undergo regeneration. It is also possible to process the light-sensitive material according to the present invention while applying electricity to the both electrodes. Upon this, various additives which can be added to the developing solution, including, for example, preserving agents, alkali agents, pH buffers, sensitizers, anti-foggant, silver sludge restrainers, etc. may be incorporated. There has been known a method of processing light-sensitive materials while applying electricity to the developing solution, and upon such a process the additives which can be added to the developer as mentioned above, may further be incorporated. When the waste developing solution is reused after regeneration treatment, it is preferable for a transition metal complex-type compound to be employed as a developing agent.

As one mode of development, the developing agent may be incorporated in the light-sensitive material, for example in an emulsion layer or a layer adjacent thereto, and developing process is carried out in an alkaline solution, which is so-called an activator processing solution. Further, a light-sensitive material comprising a developing agent in a silver halide emulsion layer or a layer adjacent thereto may be processed with a developing solution. This kind of developing process is often employed as a rapid processing method in combination with silver salt stabilization process using a thiocyanate, and the present invention may also be applicable to such a processing solution.

As a fixing solution, any one which are popularly known in the art can be used. The fixing solution is an aqueous solution containing a fixing agent and other additives, and the pH of the fixing solution is usually between 3.8 and 5.8. As the fixing agent, for example, thiocyanates such as sodium thiosulfate, potassium thiosulfate, ammonium thiosulfate, sodium thiocyanate, potassium thiocyanate, ammonium thiocyanate and other organic sulfur compounds which are capable of producing a stable silver complex salts and are known in the art as a fixing agent can be used.

Into the fixing solution, a compound which functions as a hardening agent, including, for example, water-soluble aluminium salts such as aluminium chloride, aluminium sulfate, potassium alum, aldehyde compounds (such as glutal aldehyde or its sulfite adduct, etc.) may be added.

The fixing solution may contain, if necessary, preservatives such as sulfites or metasulfites; pH buffers such as acetic acid, citric acid, etc.; pH adjuster such as sulfuric acid, or chelating agents capable of softening hard water, etc. It is preferable that the concentration of ammonium ion in the fixing solution is 0.1 mol or less per liter of the fixing solution. Particularly preferable concentration of the ammonium ion in the fixing solution is between 0 and 0.5 mol per liter of fixing solution. As the fixing agent, sodium thiosulfate may be used instead of ammonium thiosulfate. They can also be used in combination. It is preferable that concentration of acetate ion is less than 0.33/liter. There may be applicable any compounds capable of releasing an acetate ion in the fixing solution. Acetic acid or a lithium, potassium, sodium or ammonium salt thereof are preferable. Particularly preferable are sodium salt and ammonium salt. The concentration of the acetate ion is preferably 0.22 mol or less, and more preferably, 0.13 mol or less per liter of the fixing solution.

Under this condition generation of acetic acid gas can be highly restrained. Most advantageously, the fixing solution does not substantially contain any acetate ion at all.

It is preferable that the fixing solution contains a thiosulfate. As thiosulfates,for example, lithium salt, potassium salt, sodium salt, ammonium salt, etc. can be mentioned and, preferably, they are sodium salts or ammonium salts. Amount of addition of the thiosulfate is generally between 0.1 and 5 mols, preferably between 0.5 and 2.0 mols, more preferably between 0.7 and 1.8 mols and, most preferably, between 0.8 and 1.5 mols per liter of the fixing solution.

The fixing agent contains a salt of citric acid, tartaric acid, malic acid, succinic acid or an optical isomer thereof. As the salt of the citric acid, tartaric acid, malic acid or succinic acid, lithium salt, potassium salt, sodium salt, ammonium salt, etc. can be mentioned. Further, lithium hydrogen salt, potassium hydrogen salt, sodium hydrogen salt, or ammonium hydrogen salt of the tartaric acid; ammonium potassium tartarate; or sodium potassium tartarate, etc. may also be used. Among these, are preferable citric acid, isocitric acid, malic acid and succinic acid and the salts thereof; and the most preferable compound id malic acid or salts thereof.

The silver halide light-sensitive photographic material according to the present is usually subjected to process in a washing (or rinsing) bath or in a stabilizing bath. The stabilizing solution usually contains, for the purpose of stabilizing an produced image, an inorganic or organic acid or salt thereof for adjusting pH of the membrane (at pH 3–8 after processing), or an alkaline agent or a salt thereof, including, for example, boric acid, metaboric acid, borax, phosphates, carbonates, potassium hydroxide, sodium hydrioxide, ammonia water, mono-carboxylic acids, dicarboxylic acids polycarboxylic acids, citric acid, oxalic acid, malic acid acetic acid, etc.; aldehydes such as formalin, glyoxal, glutalalhehyde, etc.; chelating agents such as ethylenediamintetraacetic acid, or an alkali metal salt thereof, nitrilotriacetic acid, polyphosphates, etc.; antimolds such as phenol, 4-cylorophenol, cresol, o-phenylphenol, chlorophenol, dichlorophenol, formaldehyde, p-hydroxybenzoate, 2-(4-thiazoline)-benzimidazole, benzisothiazolin-3-one, dodecyl-benzyl-methylammonium chloride, N-(fluorodichloromethylthio)-phthalimide, 2,4,4'-trichloro-2'hydroxydiphenyl ether, etc,; toning agents and/or residual color-improving agents such as nitrogen-containing heterocyclic compounds, including, for example, 2-mercapto-5-sodiumsulfonate-benzimidazole, 1-phenyl-5-mercapto tetrazole, 2-mercaptobenzothiazole, 2-mercapto-5-propyl-1,3,4-triazole, 2-mercaptohypoxanthine, etc. Specifically, it is preferable that the stabilizing solution contains an antimold. These compounds may be replenished either in the form of a liquid or a solid. When an additive is replenished in the form of solid, the methods of manufacturing and using as afore-mentioned may be used.

In view of a demand for decreasing the amount of waste liquids, the light-sensitive materials are often processed while being replenished with a given amount of developing solution in proportion to the processed area of the light-sensitive material. Suitable replenishing amount of the developing solution and the fixing solution is 330 ml or less per square meter of the light-sensitive material, respectively. More preferably, it is between 300~200 ml, respectively. Herein the terms "replenishing amount of the developing solution" and "replenishing amount of the fixing solution" respectively denote the amount of the solution to be replenished.

Temperatures of the developing, fixing, washing and/or stabilizing solutions are preferably between 10° and 45° C., and they may be controlled separately.

In light of a demand for shortening the overall processing time, it is preferable that the overall processing time (Dry-to-Dry) from the time when the front end of a film is put into the automatic processing machine to the time when it comes out of the drying zone is between 10 to 50 seconds. The overall processing time is referred to as a period of time including all processing steps necessary for processing a black-and-white photographic light sensitive material, such as developing, fixing, bleaching, washing, stabilizing and drying, alternatively, Dry to Dry time. In the case when the overall processing time is 10 seconds or less, satisfied photographic performance cannot be achieved due to desensitization or contrast-decreasing. The overall processing time is more preferably 15 to 44 seconds. To stably process large amounts such as 10 $m^2$ or more of the photographic material, a developing time is preferably 2 to 18 seconds.

In the present invention, a heat conductive member at 60° C. or more (e.g., a heat roller heated at 60° to 130° C.) or a radiation body at 150° C. or more (by directly applying electricity to a tungsten, carbon, Nicrome, a mixture of zirconium oxide, yttrium oxide or thorium oxide to heat and emit radiation, or by conducting thermal energy from a resistance pyrogeneous substance to a radiation emissive substance such as copper, stainless, nickel and various types of ceramics to generate heat or radiative infrared rays) can preferably be used to construct the heating zone.

As the heat conductive substance at 60° C. or more, a heat roller can be mentioned as an example. The heat roller is preferably made of hollow aluminum cylinder and the peripheral surface thereof is coated with a resin such as silicon rubber, polyurethane or Teflon. Both end portions of this heat roller is preferably arranged inside the drying section in the vicinity of the in-let transport mouth of the processor with shaft bearings made of a heat resistant resin such as "Luron" (trade name) and rotationally supported against side walls of the section.

Further, it is preferable that one end portion of the heat roller is fixed with a gear, and is rotated in the direction of transport. Inside the roller of the heat roller, a halogen heater has been inserted, and the halogen heater is preferably connected to a heat regulator arranged in the automatic processing machine.

A thermister, which is arranged in contact with the peripheral surface of the heat roller, is connected to the heat regulator, and the heat regulator has preferably been set up so as to change the switch of the halogen heater, when detected temperature by the thermister is between 60° and 150° C. and more preferably, between 70° and 130° C.

As examples of substances capable of emitting radiation with temperature higher than 150° C. (more preferably, higher than 250° C.), the following substances can be mentioned: tungsten, carbon, tantalum, Nichrome, a mixture of zirconium oxide, yttrium oxide and thorium oxide, carbon silicate, molybdenum disilicate. Further, methods of directly applying electricity to a radiating element such as tungsten, carbon, Nicrome, a mixture of zirconium oxide, yttrium oxide and thorium oxide to heat and emit radiation, or conducting thermal energy from a resistance pyrogeneous substance to a radiation emissive substance such as copper, stainless steel, nickel and various types of ceramics, to generate heat or radiate infrared rays may also be used. In the invention, the heat conductive member with 60° C. or higher and the radiation body with 150° C. or higher may be combined with each other. Further, a combination of conventional hot air at 60° C. or less may be available.

In the present invention, there are preferably applicable a method or an automatic processor with mechanism, as described below.

(1) Deodorizing device: JP-A 64-37560, pp. 544(2), left upper col. to pp. 545(3), left upper col.

(2) Regenerating and cleaning agent for washing water and its device: JP-A 6-250352, pp. (3) [0011] to pp. (8) [0058].

(3) Waste liquor-treatment method: JP-A 2-64638, pp. 388 (2), left lower col. to pp. 391 (5) left lower col.

(4) Rinsing bath between a developing bath and fixing bath: JP-A 4-313749, pp. (18) [0054] to (21) [0065].

(5) Water-replenishing method: JP-A 1-281446, pp. 250 (2) left lower col. to right lower col.

(6) Method for controlling drying air of a processor by detecting outdoor temperature and humidity: JP-A 1-315745, pp496 (2) right lower col. to pp.501(7) right lower col. ;JP-A 2-108051, pp. 588 (2), left col. to 589 (3) left lower col.

(7) Method for silver recovery from fixer effluent: JP-A 6-27623 pp. (4) [0012] to (7) [0071].

There is no specific limitation as to halide composition in the silver halide emulsion used in the present invention. Preferably is used silver chlorobromide or chlorobromoiodide containing 50 mol % or more chloride.

The average grain size of the silver halide is preferably 1.2 μm or less, and, more preferably 0.8 to 0.1 μm. The term "average grain size" has been used commonly in the art. The term "grain size" usually refers to a diameter of the grain, when the grain is of spherical shape or in the form close thereto. In the case when the grain is a cubic shape, it means a diameter of a sphere when the cube is converted into a sphere having the equivalent volume. With regard to the method of obtaining the average diameter, one can refer to the disclosure on pages 36–43, third edition of C. E. Mees and T. H. James "The theory of the photographic process", pages 36–43, Macmillan Co. (1966).

There is no limitation as to the shape of the silver halide grain, and any one of tabular, cubic, spherical, tetradecahedral or octahedral shape can optionally be used. Concerning grain size distribution, the narrower, the more preferable. Particularly, so-called mono-dispersed emulsion, in which not less than 90%, preferably, 95% of the total number of grains fall within the range of the average grain size ±40%, is preferable.

The type of reaction of a soluble silver salt with soluble halide in the preparation of a silver halide emulsion may be normal precipitation, double jet precipitation or combination thereof. A method of forming grains in the presence of silver ions in excess (so-called, reversed precipitation) may be applicable. As one of the double jet precipitation is used a controlled double jet method in which the pAg of liquid phase is maintained at a given value during the course of grain formation. According to this method, there can be obtained a silver halide emulsion comprised of monodispersed grains with regular crystal form.

To effectuate the present invention, tabular grains are preferably contained in a silver halide emulsion layer of the silver halide photographic light sensitive material. The tabular grains having an aspect ratio of 2 or more account for 505 or more of the projected area of the total grains contained in the silver halide emulsion layer. The tabular grains account for preferably 60 to 70%, more preferably 80% or more of the total grain projected area. The term, "aspect ratio" is referred to as a ratio of a diameter of a circle having the area equivalent to the grain projected area to a spacing between two parallel major faces (i.e., thickness). In the present invention, since the tabular grains containing 50 mol % or more chloride have (100) major faces, a length-breadth ratio may be employed in place of the aspect ratio. The length-breadth ratio is preferably 1.2 to 8.0. The tabular grains may contain 0.001 to 1 mol % of iodide within a nucleation site. High chloride containing tabular grains can be prepared according to the method referred to U.S. Pat. No. 5,320,938. Silver halide grains containing internally high-iodide of 0.001 to 1 mol % or silver nuclei are preferable for pressure resistance. The aspect ratio or length-breadth ratio is the more, the grains become the more tabular. The thickness of the tabular grains is preferably 0.01 to 0.5 mm, but it can be optionally selected, depending on the aspect ratio and mean volume-averaged grain size. With respect to tabular grain size distribution, a conventionally-used variation coefficient (standard deviation of grain size, S divided by an mean grain size, D time 100; S/D×100) is 30% or less, preferably, 20% or less. The tabular grains may be used in combination with regular crystal grains.

Among these tabular grains, are preferably used those having a chloride content of 50 mol % or more and (100) major faces, which can be readily prepared according to the manner described in U.S. Pat. Nos. 5,264,337, 5,314,798, and 5,320,958. On a specific site of the tabular grains, different silver halide can be epitaxially grown up or shelled. The tabular grains may have dislocation lines on the surface or in the interior of the grain to control sensitivity speck. The dislocation line can be formed by allowing fine silver iodide grains to be present or adding a soluble iodide during the course of chemical sensitization. With respect to preparation of the grains, acidic precipitation, neutral precipitation and ammoniacal precipitation may be optionally selected. In cases where metal is doped within the grain, it is preferred to form grains under the acidic condition of a pH of 1 to 5. To control grain growth during the course of grain formation is used a silver halide solvent, such as ammonia, thioethers, thiourea compounds, and thione compounds. The thioethers include 3,6,9,15,21-hexaoxa-12-thiatricosane; 3,9,15-trioxa-6,12-dithiaheptadecane;1,17-dioxy-3,9,15-trioxa-6,12-dithiaheptadecane-4,14-dione;1,20-dioxy-3,9,12,18-teraoxa-6,15-dithiaeicisane-4,17-dione; and 7,10-dioxa-4,13-dithiahexadecane-2,15, dicarboxamide, as described in German Patent 1,147,845. Oxathioethers described in JP-A56-94347 and 1-121847 and cyclic oxathioethers described in JP-A 63-259653 and 63-301939 are also cited. Thioureas described in JP-A 53- 82408 are usable. As exemplary examples thereof are cited tetramethylthiourea, tetraethylthiourea, dimethylpiperidinothiourea, dimorphorinothiourea; 1,3-dimethylimidazole-2-thione; 1,3-dimethylimidazole-4-phenyl-2-thione; and tetrapropylthiourea.

At the time of physical ripening or chemical ripening, metal salts of zinc, lead, thallium, iridium, rhodium, ruthenium, osmium, paradium, platinum, etc. can be coexisted. It is often commonly used to incorporate $10^{-8}$–$10^{-3}$ of iridium per mol silver halide for the purpose of improving high intensity reciprocity law failure characteristics. In the present invention, in order to obtain an emulsion with high contrast, it is preferable for $10^{-9}$ to $10^{-3}$ mol of rhodium, ruthenium, osmium and/or rhenium per mol of silver halide to be incorporated in the silver halide emulsion.

A metal compound may be added in the form of a complex salt, in which the metal is coordinate with a halogen, carbonyl, nitrocyl, thionitrocyl, amine, cyan, thiocyan, ammonia, tellurocyl, selenocyan, dipyridyl, tripyridyl, phenanthroline or a combination thereof. The oxidation state of the metal may be optionally selected within the range of the minimum level to the maximum level. As preferred ligands are cited hexa-dentated ligands described in JP-A 2-2082, 2-20853, 2-20854 and 2-20855; alkali metal salts include a sodium salt, potassium salt and cesium salt and primary secondary and tertiary amines are also cited. A transition metal complex salt may be formed in the form of an aquo-complex. Examples thereof include $K_2[RuCl_6]$, $(NH_4)_2[RuCl_6]$, $K_2[Ru(NOCl_4(SCN)]$, and $K_2[RuCl_5(H_2O)]$. Ru may be replaced by Rh, Os, Re, Ir, Pd or Pt.

It is preferable that rhodium, ruthenium, osmium and/or rhenium compound is added during the time of forming silver halide grains. Addition thereof may be optional, including a method of distributing uniformly inside the grain and a method of localizing in the core or shell portion of core/shell-structure grains.

Often, better results are obtained in the case when they are made present in the shell portion. Further, in the case when they are made present in a discrete layer structure, a method in which amount of presence is made greater depending on the distance from the center of the grain, may also be applied. Amount of addition may optionally be selected from the range between $10^{-9}$ and $10^{-3}$ mol per mol of silver halide.

Silver halide emulsions and preparation methods thereof are referred to Research Disclosure 17643 pages 22–23 (December 1973) and the references referred therein.

The silver halide emulsion used in the present invention may or may not be chemically sensitized. As method of chemical sensitization, sulfur sensitization, selenium sensitization, tellurium sensitization, reduction sensitization and noble metal sensitization have been well known in the art, and these methods may be used either singly or in combination. As a sulfur sensitizer, conventionally known sulfur sensitizers may be used. Preferable sulfur sensitizers include, besides sulfur compounds contained in gelatin, various sulfur compounds, for example, thiosulfates, thio ureas, rhodanines, polysulfide compounds, etc. can be used. As selenium sensitizers, known selenium sensitizers may be used. For example, those compounds disclosed in U.S. Pat. No. 1,623,499, JP-A 50-71325 and 60-150046 may preferably be used.

As tellurium sensitizers, known tellurium sensitizers can be used. For example, those compounds disclosed in U.S. Pat. No. 1,623,499. JP-A 50-71325 and 60-150046 can preferably be used. Among noble metal sensitization, gold sensitization is typical one, and gold compounds, mainly gold complexes are used. Other noble metal compounds, for example, complexes of platinum, paradium, rhodium, etc. may also be used. As reduction sensitizers, stannous salts, amines, formamidine sulfinic acids, silane compounds, etc. can be used.

Sensitizing effects of these sensitizers can be enhanced by the addition in the form of a fine particle dispersion. The addition of silver iodide in the form of fine particle dispersion during chemical ripening leads to formation of silver iodide on the surface of the grain, resulting in enhancement of effect of spectral sensitization of a dye. In the case of silver iodide formation of the tabular grains, contribution of dislocations of 0 to 1000 lines is often employed.

Selenium sensitizers usable in the selenium sensitization include various selenium compounds, as described in U.S. Pat. Nos. 1,574,944, 1,602,592 and 1,623,499, JP-A 60-150046, 4-25832, 4-109240 and 4-147250. As examples of usable selenium sensitizers are cited colloidal selenium, isoselenocyanates such as allylisoselenocyanate; selenoureas such as N,N-dimethylselenourea, N,N,N'-triethylselenourea, N,N,N'-trimethyl-N'-heptafluoroselenourea, N,N,N'-trimethyl-N'-heptafluoropropylcarbonyl-selenourea and N,N,N'-trimethyl-N'-nitrophenylcarbonyl-selenourea; selenoketones such as selenoacetone and selenoacetophenone; selenoamides such as selenoacetoamide and N,N-dimethylselenobenzamide; selenocarboxylic acids and selenoesters such as 2-selenopropionic acid and methyl-3-selenobutylate; selenophosphates such as tri-p-triselenophosphate; selenides such as triphenylphosphine selenide, diethyl selenide and diethyl selenide. Among these selenium sensitizers are preferred selenoureas, selenoamides, selenoketones and selenides.

Examples of technique for using the selenium sensitizer are disclosed in U.S. Pat. Nos. 1,574,944, 1,602,592, 1,623,499, 3,297,446, 3,297,447, 3,320,069, 3,408,196, 3,408,197, 3,442,653, 3,420,670 and 3,591,385. The using amount of the selenium sensitizer, depending on a selenium compound, silver halide, chemical ripening condition, is generally $10^{-8}$ to $10^{-3}$ mol per mol of silver halide. With respect to addition of the selenium sensitizer, it may be added by dissolving in water or an organic solvent such as methanol or ethanol, by mixing with a gelatin solution, or in the form of an emulsified dispersion of a mixture solution with an organic solvent-soluble polymer described in JP-A 4-140739. The sensitizer may be used in the form of a dispersion of solid particles having sizes of 0.01 to 500 $\mu$m. The solid particle dispersion can be prepared according to a method of a solid particle dispersion of a colorant or dye. The chemical-ripening temperature by use of the selenium sensitizer is preferably 40° to 90° C. and more preferably 45° to 80° C. The pH and pAg are preferably 4 to 9 and 5 to 10, respectively, by adjusting with a water soluble halide such as potassium bromide and sodium chloride or silver nitrate.

Besides the selenium compound is usable a tellurium compound. The tellurium compound can be represented by replacing Se of the selenium compound by a Te atom. Examples thereof include N,N-dimethyltellurourea, N,N,N'-triethyltellurourea, N,N,N'-trimethyl-N'-heptafluorotellurourea, N,N,N'-trimethyl-N'-4-nitrophenylcarbonyltellurourea, diphenyltetrafluorophenyltellurophosphate, diphenylpentafluorophenyltellurophosphate and triphenylphosphine telluride.

The silver halide emulsion may be spectrally sensitized to an optional spectral wavelength with a sensitizing dye. Useful sensitizing dye includes, for example, cyanine dyes, merocyanine dyes, complex cyanine dyes, complex merocyanine dyes, holopolar cyanine dyes, hemicyanine dyes, styryl dyes, and hemioxonol dyes. To these dyes, any nucleus applied to the cyanine dyes may be applied as a basic heterocyclic nucleus. That is to say, pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; and those nuclei fused with an alicyclic hydrocarbon ring or an aromatic hydrocarbon ring, i.e., indolenin nucleus, benzindolenin nucleus, indole nucleus, benzoxazole nucleus, naphthoxazole nucleus, benzthiazole nucleus, naphthothiazole nucleus, benzselenazole nucleus, benzimidazole nucleus, quinoline nucleus, etc. may be applied. These nuclei may be substituted on a carbon atom thereof. To merocyanine dyes or complex merocyanine dyes, as a nucleus having a ketomethylene structure, five-membered or six-membered heterocycle, such as thiohydantoin nucleus, 2-thiooxazolidine-2,4-di-one nucleus, rhodanine nucleus, thiobarbituric acid nucleus, etc. can be applied. More specifically, those compounds disclosed in Research Disclosure (RD) No. 17643, on pages 2 and 3 (December 1978), U.S. Pat. Nos. 4,425,425, 4,425,426 can be used. The sensitizing dye may be dissolved by means of ultrasonic dispersion disclosed in U.S. Pat. No. 3,485,634. As other methods for dissolving or incorporating the sensitizing dye used in the present invention in the emulsion, those methods disclosed in U.S. Pat. Nos. 3,482,981, 3,585,195, 3,469,987, 3,425,835, 3,342,605; British Patent Nos.1,271,329, 1,038, 029, 1,121,174; U.S. Pat. Nos. 3,660,101 and 3,658,634 can be used. These sensitizing dyes may be used either singly or in combination. Combined use of the sensitizing dyes are often employed for the purpose of super-sensitization. Useful combinations of the sensitizing dyes exhibiting super-sensitization are disclosed in Research Disclosure (RD) No.17643 (December 1978), on page 23 IV-J.

In the light-sensitive material according to the present invention can comprise a variety of compounds for the purpose of preventing fog during manufacture, storage or photographic processing of the light-sensitive material. Those compounds include compounds which are known as stabilizers or anti-foggants in the art. For example, azoles such as benzthiazolium salts, nitroindazoles, chlorobenzimidazoles, bromobenzimidazoles, mercaptothiazoles, mercaptobenzthiazoles, mercaptobenzimidazoles, mercaptobenzthiadiazoles, aminotriazoles, benztriazoles, nitrobenztriazoles, mercaptotetrazoles, such as 1-phenyl-5-mercaptotetrazole, etc.; mercaptopyrimidines, mercaptotriazines, thioketo compounds such as oxazolinethione; azaindenes such as triazaindenes, tetrazaindenes including 4-hydroxy-substituted 1,3,3a,7-tetrazaindenes, pentazaindenes, etc., benzenethiosulfonic acid, benzenesulfinic acid, benzenesulfonic acid amide, etc. can be mentioned.

As binder or a protective colloid of the photographic emulsion used in the present invention, gelatin is advantageously used, however, other hydrophilic colloids may also be used. The hydrophilic colloids include, for example, gelatin derivatives, graft polymers comprised of gelatin and other polymers; proteins such as casein, albumin, etc.; cellulose derivatives such as hydroxyethyl cellulose, carboxymethyl cellulose, cellulose sulfates, etc.; sugar derivatives such as sodium alginate, starch derivatives, etc.; synthetic hydrophilic polymers such as polyvinyl alcohol and partial acetal thereof, poly-N-pyrrolidone, polyacrylic acid, polymethacrylic acid, polyacrylamide, polyvinyl imidazole, polyvinyl pyrazole, etc. These polymers may be either homopolymers or copolymers. As gelatin, there may be usable an acid process gelatin as well as lime-processed gelatin. Further, hydrolytic products or enzyme decomposition products of gelatin may also be used.

In the photographic emulsion according to the present invention, for the purpose of improving dimensional stability, etc., synthetic polymers which are water-insoluble, or sparingly water-soluble can be incorporated. For example, alkyl(metha)acrylates, alkoxy(metha)acrylates, glycidyl(metha)acrylates, (metha)acrylamides, vinyl esters such as vinyl acetate, acrylonitrile, styrene, etc. may be used either singly or in combination. Further, these polymers may be used in the form of a copolymer together with other monomer constituents such as acrylic acid, methacrylic acid, α,β-unsaturated dicarboxylic acid, hydroxylalkyl(metha)acrylate, sulfoalkyl(metha)acrylate, styrene sulfonic acid, etc.

In the invention, at least one of component layer of the photographic material preferably contains a hydrophilic polymer. Preferred hydrophilic polymers include starch, glucose, dextrin, dextran, cyclodextrin, sugar, maltose and xanthane gum. The hydrophilic polymer is optionally selected from ones having a molecular weight of 600 to 1,000,000. The lower molecular weight is more preferable, since the polymer is dissolved out into a processing solution. However, in cases where the molecular weight id to low, it results in deterioration in film strength, so that at least a molecular weight of 400 is required. Since the use of the hydrophilic polymer leads to deterioration in abrasion resistance of the film, it is preferred to add an inorganic compound, such as colloidal silica, colloidal tin, colloidal zinc, colloidal titanium, colloidal yttrium, colloidal praseodymium, neodymium, zeolite or apatite. Examples of the zeolite include analsite, erionite, moldenite, moldenite, shabasite, gumerinite and levinite, and as a synthetic zeolite is cited zeolite A, X, Y or L. The apatite includes hydroxyapatite, fluoroapatite and chloroapatite. Adding amounts thereof are preferably 1 to 200% by weight based on a hydrophilic binder. The inorganic compound above described becomes less liable to be coagulated by the use of a silane coupling agent when added into an emulsion, resulting in a stabilized coating solution and prevention of crack due to the inorganic compound. The silane coupling agent includes triethoxysilanovinyl, trimethoxysilanovinyl, trimethoxypropylmethaacrylate, trimethoxysilanopropylglycidyl, 1-mercapto-3-triethoxysilanopropane-1-amino-3-triethoxysilanopropane, triethoxysilanophenyl and triethoxymethylsilane. The combined use of the silane coupling agent with the inorganic compound at a high temperature leads to enhanced characteristics, as compared to its single use. A mixing ratio is preferably within a range of 1:100 to 100:1.

In the invention, at least a hydrophilic colloidal layer is provided on an opposite side of a support opposite to the silver halide emulsion layer side and further thereon, a hydrophobic polymer layer is preferably provided. The hydrophilic colloidal layer on the side opposite to the silver halide emulsion layer includes so-called backing layer. In the invention, at least one hydrophobic polymer layer is preferably provided on an outer-side of the backing layer.

The word, "hydrophobic polymer layer" is referred to as a layer containing a hydrophobic polymer, as a binder. Examples of the polymer include polyethylene, polypropylene, polystyrene, polyvinyl chloride, polychlorovinylidene, polyacrylonitrile, polyvinyl acetate, polyurethane, an urea resin, a melamine resin, phenol resin, an epoxy resin, a fluorinated resin such as tetrafluoroethylene or polyfluorovinylidene, a rubber such as butadiene rubber, chloroprene rubber or natural rubber, an acrylate or methaacrylate ester such as polymethylmethaacrylate or polyethylacrylate, a polyester resin such as polyethylene terephthalate, a polyamide resin such as nylon 6 or nylon 66, a cellulose resin such as cellulose triacetate, a water-insoluble polymer, such as silicone resin, and their derivatives. The polymer as the binder may be a homopolymer comprised of one kind of a monomer or copolymer comprised of two or more kinds of monomers. As preferred polymers are cited a copolymer of an alkylacrylate or alkylmethaacrylate with acrylic acid or methaacrylic acid (preferably, 5 mol % or less of acrylic acid or methaacrylic acid), styrene-butadiene copolymer, styrene-butadiene-acrylic acid copolymer (preferably, 5 mol % or less of acrylic acid), styrene-butadiene-divinylbenzene-methaacrylic acid copolymer (preferably, 5 mol % or less of methaacrylic acid), vinyl acetate-ethylene-acrylic acid copolymer (preferably, 5 mol % or less of acrylic acid), vinylidene chloride-acrylonitrile-methylmethaacrylate-ethylacrylate-acrylic acid copolymer (preferably, 5 mol % or less of acrylic acid), and ethylacrylate-glycidylmethaacrylate-acrylic acid copolymer. These may be used singly or in combination.

The hydrophobic polymer layer may contain optionally fine particles, such as a matting agent, surfactant, dyestuff, lubricant, thickener, UV absorbent and colloidal silica. These additives may be referred to Research Disclosure Vol. 176, 17643 (Dec., 1978). The hydrophobic polymer layer may be one layer two or more layers. The thickness of the polymer layer may be optional and non-limitative. In cases where the thickness of the hydrophobic polymer layer is too thin, water resistance of the hydrophobic layer is insufficient and the backing layer is swollen with a processing solution, so that it is not appropriate. On the contrary, in cases where the hydrophobic polymer layer is too thick, water vapor permeability becomes insufficient and moisture adsorption and desorption of the backing hydrophobic colloidal layer are inhibited, resulting in improper curl. As the thickness of the hydrophobic polymer layer depends on physical properties of the polymer binder used, the thickness must be determined taking account of the both described above. The thickness is preferably 0.05 to 10 $\mu$m, and more preferably 0.1 to 5 $\mu$m. In cases where the hydrophobic polymer layer comprises two or more layers, the thickness refers to the total thickness thereof.

A method of coating the hydrophobic polymer layer is not limitative. The polymer layer may be coated on the backing layer after the backing layer is coated and dried, or it may be simultaneously coated with the backing layer. The hydrophobic polymer layer may be coated in a solvent system in which the polymer is dissolved or in an aqueous system in which the polymer is dispersed in the form of an aqueous dispersion.

On the opposite side of the support to the emulsion layer side of the black-and-white photographic light sensitive material of the invention, are provided a backing layer including a adhesive layer/antistatic layer/hydrophilic colloidal layer, and a hydrophobic layer. Further thereon may be provided a protective layer. The adhesive layer containing vinylidene chloride copolymer or styrene-glycidylacrylate copolymer is coated in a thickness of 0.1 to 1 $\mu$m on a support subjected to corona discharge treatment and further thereon is provided a gelatin layer containing fine particles of tin oxide or vanadium pentaoxide doped with indium or phosphorus and having a particle size of 0.01 to 1 $\mu$m. Copolymer of styrene sulfonic acid and maleic acid may be coated by hardening with a azirizine hardener or activated carbonyl group type hardener. A dyed backing layer may be provided on the antistatic layer. These layers may contain an inorganic filler for dimensional stability such as colloidal silica, a silicone type slipping agent for controlling transportation or a releasing agent. The backing layer may contain a backing dye, such as benzilidene dye or oxonol dye. An alkali soluble or degradable dye may be added in the form of fine particles. The density necessary for antihalation is preferably 0.1 to 2.0 for each wavelength.

A silver halide emulsion layer or light-insensitive hydrophilic colloidal layer used in the invention may contains an or inorganic hardener, such as chromium salts (chrome alum, chrome acetate etc.), aldehydes (formaldehyde, glutar aldehyde, glyoxal etc.), N-methylol compounds (dimethylol urea, dimethylol dimethylhydantoin etc.), dioxane derives (2,3-dihydroxydioxane), active vinyl compounds (1,3,5-triacryloyl-hexahydro-s-triazine, bis)vinylsulfonyl)methyl ether, N,N-methylenebis-[β-(vinylsulfonyl)propioneamide], etc.), active halogen compounds (2,4-dichloro-6-hydroxy-s-triazine, etc.), mucohalogenic acids (mucochloric acid, phenoxymucochloric acid, etc.) isooxazoles, dialdehyde starch, 2-chloro-6-hydroxytriazinyl gelatin, and carboxyl group-activating type hardeners, singly or in combination thereof. These hardeners are described in Research Disclosure Vol. 176, item 17643 (Dec., 1978), page 26, section A-C.

The silver halide emulsion layer or light-insensitive hydrophilic colloidal layer may optionally contain a coating aid, antistatic agent, slipping agent, emulsifying agent and various additives for preventing adhesion or improving photographic characteristics.

Each layer may contain, besides gelatin, a hydrophilic colloid such as dextrins, starch or glucose, or hydrophobic lattices to adjust a swelling ratio. The swelling ratio is generally 120 to 200. Each layer is dried by adjusting a drying temperature and time in response to the moisture vaporizing speed. The drying temperature and time are generally within a range of 25° to 200° C. and 0.1 to 200 sec., respectively. The swelling ratio can be determined by dipping in water and then measuring by microscope or a swell meter. The swelling ratio is referred to as a ratio of a swelling thickness in water at 23° C. (Lw) to thickness of dried coating (Ld), which is defined as a thickness of layer which has been allowed to stand at 23° C. and 50% R.H. for 24 hr., i.e., Lw/Ld ×100.

Determination of surface tension and wetting index is referred to JIS (Japanese Industrial Standard).

The pH of the layer on a silver halide emulsion layer side of the photographic material relating to the invention is preferably 4.5 to 5.8. The layer pH is defined as a pH value measured after being coated and dried. The pH measurement is made by putting water of 1 ml on a measuring area of 1 $cm^2$ and measuring with a pH meter. The pH can be decreased by using an acid such as citric acid, oxalic acid, hydrochloric acid, sulfuric acid, nitric acid, acetic acid or carbonic acid and increased by using an alkali such as sodium hydroxide, potassium hydroxide, sodium carbonate, sodium hydrogen carbonate or sodium acetate. The pH adjustment at the time when adding photographic additives are made in a similar manner.

Various additives are further employed in the photographic material relating to the invention, including a desensitizer, plasticizer, lubricant, development accelerating agent and oil.

A support used in the present invention may be a transparent or nontransparent one, and a transparent plastic resin support is preferred for the purpose of the invention. As the plastic resin support may be employed a support comprising a polyethylene compound (e.g., polyethylene terephthalate, polyethylene naphthalate), a triacetate compound (e.g., triacetate cellulose), or polystyrene compound. Among these, in the invention, a stretched film support comprised of styrene type polymer having syndiotactic structure or a composition thereof (hereinafter, denoted as SPS) is especially preferred for enhancement of drying characteristics and dimensional stability in an automatic processor. The SPS is referred to as a homopolymer of which constituting unit comprises a SPS unit having a syndiotactic stereoregularity, including a SPS modified with a second component of 20 mol % or less, preferably 10 mol % or less and more preferably 5 mol % or less. As examples of the second component are cited a olefin monomer such as ethylene, propylene, butene or hexene; a diene monomer such as butadiene or isoprene; cyclic olefin monomer; cyclic diene monomer; and polar vinyl monomer such as methyl methaacrylate, anhydrous maleic acid or acrylonitrile. Generally, these are prepared by polymerizing styrene or its derivative under an optimal condition, by using a organic metal catalyst. The syndiotactic polystyrene is referred to as one having a stereoregularity of 75% or more and preferably 80% or more in terms of racemo-diad, or 30% or more and preferably 50% or more in terms of racemopentad. In this case, a conventionally used plasticizer may be added as the second component in such an amount that does not deteriorate a bending elastic modulus. This is made for obtaining an appropriate bending elastic modulus.

The SPS can be synthesized by polymerizing a styrene or its derivative in the presence of a catalyst of a condensation product of a titanium compound and a trialkyl aluminum at an optimal temperature, with reference to the method described in JP-A 62-187708, 1-46912 and 1-178505. The polymerization degree of the SPS is not limitative, but is preferably within a range of 10,000 to 5,000,000. It is necessary to select optimal stretching conditions for enhancement of the bending elastic modulus of the SPS. A film is stretched by 3.3±0.3 times in the longitudinal direction at a temperature of 30°±25° C. higher than a glass transition temperature of an unstretched film, i.e., 120°±25° C. Subsequently, the film is further stretched by 3.6±0.6 times in the lateral direction at the same temperature. Heat treatment after stretching is carried out at 230°±18° C. The two-stage heat treatment leads to better results than the one-stage treatment. Thus, a SPS film having a bending elastic modulus of 350 kg/mm$^2$ or more can be prepared.

It is rather difficult to coat a photographic layer as such on a film with such a high bending elastic modulus to be adhered strongly thereto. Its method is referred to many patents and literature, as described in JP-A 3-54551, pages 3–4. With regard to surface treatments, for instance, there are described corona discharge treatment and sublayer coating. As the sublayer is cited vinylidene chloride, methaacrylic acid, acrylic acid, itaconic acid or anhydrous maleic acid.

The thickness of the support is preferably 50 to 250 $\mu$m and more preferably 70 to 200 $\mu$m. To make improvements in roll set curl, it is preferred to subject to heat treatment after casting of base. The treatment is most preferably after casting of base and before emulsion coating, but it may be made after emulsion coating. The condition for the heat treatment at a temperature of not lower than 45° C. and not higher than a glass transition temperature and over a period of one second to ten days is preferred. From the point of productivity is preferred a period within one hour.

In the invention, the following compounds are preferably contained in a silver halide photographic light sensitive material.

(1) Dye in the form of a fine solid particle dispersion

Compounds described in JP-A 7-5629 page 3, [0017] to page 16 [0042].

(2) Compound having an acidic group:

Compounds described in JP-A 62-237445 page 3, left lower column line 11 to page 25, right lower column line 3.

(3) Acidic polymer

Compounds described in JP-A 6-186659 page 10, [0036] to page 17 [0062].

(4) Sensitizing dye

Compounds described in JP-A 5-224330 page 3, [0017] to page 13 [0040].

Compounds described in JP-A 6-194771 page 11, [0042] to page 22 [0094].

Compounds described in JP-A 6-242533 page 2, [0015] to page 8 [0034].

Compounds described in JP-A 6-337492 page 3, [0012] to page 34 [0056].

Compounds described in JP-A 337494 page 4, [0013] to page 14 [0039].

(5) Supersensitizer

Compounds described in JP-A 6-347938 page 3, [0011] to page 16 [0066].

(6) Redox compound

Compounds described in JP-A 4-245243 page 7 to page 22.

The above described additives and other known additives are referred to Research Disclosure No. 17643 (December, 1978) pages 23 to 29; ibid No. 18716 (November, 1979) pages 648 to 651; ibid No. 308119 (December, 1989) pages 996 to 1009.

These various types of photographic additives used in the present invention may be incorporated in the light-sensitive material according to the present invention in the form of an aqueous solution or a solution of an organic solvent. When the additive is hardly soluble in water, it may also be incorporated in the form of a dispersion of fine crystalline particles dispersed in water, gelatin, or hydrophilic or hydrophobic polymer. In order to disperse the above-mentioned dye, sensitizing dye, desensitizing dye, a hydrazine, a redox compound, anti-foggant, ultraviolet-ray absorbent, etc., any conventionally used dispersing machine can be used. Specifically, a ball-mill, a sand-mill, a colloid mill, ultrasonic homogenizer or a high-speed impeller can be mentioned. These photographic additive dispersion is comprised of fine particles with the average particle size of less than 100 $\mu$m, preferably, 0.02 and 10 $\mu$m. Methods of dispersion include, for example, a method of mechanically stirring at a high speed (JP-A 44-22948); a method, in which an additive is dissolved, with heating, in an organic solvent, and, then dispersed, while adding gelatin or a hydrophilic polymer containing a surface active agent or a an deforming agent and removing the organic solvent (JP-A 44-22948); a method in which an additive is dissolved in citric acid, acetic acid, sulfuric acid, hydrochloric acid or malic acid and dispersed in a polymer with the pH of 4.5 to 7.5 to form precipitates; and a method in which an additive is dissolved in an alkali solution such as sodium hydroxide, sodium hydrogen carbonate, sodium carbonate, etc. and dispersed in a hydrophilic binder such as gelatin with the pH of 4.5 to 7.5 to form precipitates (JP-A 2-15252), etc. can be applied. For example, a hydrazine compound, which is sparingly soluble in water may be dissolved with reference to the method disclosed in JP-A 2-3033, and this method may be applied to other additives having the similar nature. Similarly, the fixing rates of dyes, sensitizing dyes, restraining agents, etc. having a carboxylic group in the molecule can be elevated by making use of chelating ability of the carboxylic group. That is to say, it is preferable to make them hardly soluble salts by adding 200 to 4,000 ppm of calcium ion, magnesium ion, etc. to the hydrophilic colloidal layer. Once a hardly-soluble salt is formed, use of other salts are not restricted. The method of incorporation of photographic additives in the form of a dispersion of solid fine particles into the light-sensitive photographic material according to the present invention can optionally be applied depending on the chemical and physical properties to other photographic additives such as sensitizers, dyes, restrainers, accelerators, contrast-increasing agents and its accelerator, etc.

In the invention, in order to simultaneously coat a plurality of constituent layers of two to ten, slide-hopper coating method or the curtain coating method disclosed in U.S. Pat. Nos. 3,663,374 and 3,508,947 can be used. To make improvement in uneven coating, it is effective to lower the surface tension of a coating solution or to use the above-mentioned hydrophilic polymers capable of providing thixotropic property in which lowering in viscosity is caused by shearing force.

In the photographic material according to the present invention, a crossover light-cutting layer, an anti-static layer, an anti-halation layer and a backing layer may also be provided.

As a method of packaging the photographic material according to the present invention, any method known in the art may be applied.

Since silver halide photographic light sensitive materials are vulnerable to heat and moisture, it is preferable to avoid storage under severe conditions. Generally, it is preferable to keep them at a temperature of 5° to 30° C. Concerning moisture, the relative humidity is preferably 35 to 60%. For the purpose of protecting from humidity, they are generally wrapped with 1 –2,000-μm-thick polyethylene. Permeation of moisture can be restricted by enhancing the crystalinity of polyethylene by the use of a metallocene catalyst. Permeation of moisture may also be restricted by coating the surface of polyethylene with 0.1 to 1,000-μm-thick silica by evaporation.

EXAMPLES

The present invention is further explained with reference to examples; however, the scope of the invention is not limited to these examples.

Example 1

PREPARATION OF SUPPORT

Synthesis of SPS

To toluene of 200 parts (by weight) was added styrene of 100 parts, together with triisobutyl aluminum and pentamethylcyclopentadienyltitanium trimethoxide and the mixture was subjected to reaction at 96° C. for a period of 8 hr. After removing the catalyst with sodium hydroxide, washing was made three time to obtain a final product, 34 parts of SPS(Syndiotactic polystyrene).

Preparation of SPS film

Thus prepared SPS was extruded in the form of film through T-die at 330° C. and rapidly cooled down on a cooling drum to obtain unstretched film. The resulting film was previously heated at 135° C., stretched in the longitudinal direction (3.1 times), further lateral-stretched at 130° C. (3.4 times) and then thermally fixed at 250° C. Resultingly, there was obtained a biaxial-stretched film with a thickness of 100 μm and bending elastic modulus of 450 kg/mm$^2$.

Subbing of SPS film

On the SPS film, silica was deposited by vacuum evaporation and further thereon was coated styrene-glycidylacrylate and gelatin to form a adhesive layer.

Preparation of silver halide photographic material

Preparation of silver halide emulsion A

Applying double jet precipitation, there were prepared silver bromochloride core grains having 70 mol % chloride content, average thickness of 0.05 μm and average diameter of 0.15 μm. $K_3RuCl_6$ of $8\times10^{-8}$ mol per mol of silver was added during the formation of the core grains. Shell was further formed on the core grain by double jet precipitation with adding $K_2IrCl_6$ of $3\times10^{-7}$ mol per mol of silver. The resulting emulsion was comprised of monodispersed, core/shell type, tabular silver iodobromochloride grains (Cl:90 mol %, I:0.2 mol %) having an average thickness of 0.10 μm, average diameter of 0.25 μm, variation coefficient of 10% and (100) major faces. The emulsion was desalted using modified gelatin described in JP-A 2-280139 (e.g., G-8 exemplified therein, in which an amino group of gelatin was substituted by phenylcarbamoyl). After desalting, the EAg was 190 mV at 50° C.

To the emulsion was added 4-hydroxy-1,3,3a,7-tetrazaindene of $1\times10^{-3}$ mol per mol of silver and potassium bromide and citric acid were further added thereto to adjust the pH and EAg to 5.6 and 123 mV, respectively. Thereafter, the emulsion was chemical ripened at 60° C. by adding chloroauric acid of $1.2\times10^{-5}$ mol and elemental sulfur of $3\times10^{-6}$ mol. After completing chemical-ripening were added 4-hydroxy-1,3,3a,7-tetrazaindene of $2\times10^{-3}$ mol per mol of silver, 1-phenyl-5-mercaptotetrazole of $3\times10^{-4}$ mol and gelatin to obtain emulsion A.

Preparation of silver halide emulsion B

Applying double jet precipitation, there were prepared silver bromochloride core grains containing 70 mol % chloride and 2.5 mol % iodide and having average thickness of 0.05 μm and average diameter of 0.15 μm. $K_3Rh(H_2O)Br_5$ of $2\times10^{-8}$ mol per mol of silver was added during the formation of the core grains. Shell was further formed on the core grain by double jet precipitation with adding $K_2IrCl_6$ of $3\times10^{-7}$ mol per mol of silver. The resulting emulsion was comprised of monodispersed, core/shell type, tabular silver iodobromochloride grains (Cl:90 mol %, I:0.5 mol %) having an average thickness of 0.10 μm, average diameter of 0.42 μm and variation coefficient of 10%. The emulsion was desalted using modified gelatin described in JP-A 2-280139 (e.g., G-8 exemplified therein, in which an amino group of gelatin was substituted by phenylcarbamoyl). After desalting, the EAg was 180 mV at 50° C. To the emulsion was added 4-hydroxy-1,3,3a,7-tetrazaindene of $1\times10^{-3}$ mol per mol of silver and potassium bromide and citric acid were further added thereto to adjust the pH and EAg to 5.6 and 123 mV, respectively. Thereafter, the emulsion was chemical ripened at 60° C. by adding chloroauric acid of $1.2\times10^{-5}$ mol and N,N,N'-trimethyl-N'-heptafluoroselenourea of $3\times10^{-5}$ mol. After completing chemical-ripening were added 4-hydroxy-1,3,3a,7-tetrazaindene of $2\times10^{-3}$ mol per mol of silver, 1-phenyl-5-mercaptotetrazole of $3\times10^{-4}$ mol and gelatin to obtain emulsion B.

Preparation of silver halide photographic material for use in print-making scanner with He—Ne laser light source:

On one side of the subbed support above-described were simultaneously coated a gelatin subbing layer of formula 1 with a gelatin coating amount of 0.5 g/m$^2$, a silver halide emulsion layer (1) of formula 2 with a silver coating amount of 1. 5 g/m$^2$ and a gelatin coating amount of 0.5 g/m$^2$, an interlayer of formula 3 with a gelatin coating amount of 0.3 g/m$^2$, a silver halide emulsion layer (2) of formula 4 with a silver coating amount of 1.4 g/m$^2$ and a gelatin coating amount of 0.4 g/m$^2$, and a protective layer of formula 5 with a gelatin coating amount of 0.6 g/m$^2$, in this order from the support. On the opposite side of the support were coated a backing layer of formula 6 with a gelatin coating amount of 0.6 g/m$^2$, a hydrophobic polymer layer of formula 7 and further thereon a backing protective layer of formula 8 with a gelatin coating amount of 0.4 g/m$^2$ at the same time with the emulsion-side.

| | |
|---|---|
| Formula 1 (Gelatin sublayer) | |
| Gelatin | 0.5 g/m$^2$ |
| Dye AD-1, solid particle dispersion (average particle size, 0.1 μm) | 25 mg/m$^2$ |
| Sodium polystyrenesulfonate (average molecular weight, 500000) | 10 mg/m$^2$ |
| S-1 (Sodium isoamyl-n-decylsulfosuccinate) | 0.4 mg/m$^2$ |
| Formula 2 (Silver halide emulsion layer-1) | |
| Silver halide emulsion A (silver equivalent amount) | 1.5 g/m$^2$ |
| Dye AD-8, solid particle dispersion (average particle size, 0.1 μm) | 20 mg/m$^2$ |
| Cyclodextrin (hydrophilic polymer) | 0.5 g/m$^2$ |
| Sensitizing dye d-1 | 5 mg/m$^2$ |
| Sensitizing dye d-2 | 5 mg/m$^2$ |
| Hydrazine compound H-7 | 20 mg/m$^2$ |
| Redox compound RE-1 | 20 mg/m$^2$ |
| Compound e | 100 mg/m$^2$ |
| Latex polymer f | 0.5 mg/m$^2$ |
| Hardener g | 5 mg/m$^2$ |
| S-1 | 0.7 mg/m$^2$ |
| 2-mercapto-6-hydroxypurine | 5 mg/m$^2$ |
| Sodium ethylenediaminetetraacetate | 30 mg/m$^2$ |
| Colloidal silica (average particle size, 0.05 μm) | 10 mg/m$^2$ |
| Formula 3 (Interlayer) | |
| Gelatin | 0.3 g/m$^2$ |
| S-1 | 2 mg/m$^2$ |
| Formula 4 (Silver halide emulsion layer) | |
| Silver halide emulsion B (silver equivalent amount) | 1.4 g/m$^2$ |
| Sensitizing dye d-1 | 3 mg/m$^2$ |
| Sensitizing dye d-2 | 3 mg/m$^2$ |
| Hydrazine compound H-20 | 20 mg/m$^2$ |
| Nucleation accelerating agent Nb-12 | 40 mg/m$^2$ |
| Redox compound RE-2 | 20 mg/m$^2$ |
| 2-Mercapto-6-hydroxypurine | 5 mg/m$^2$ |
| Sodium ethylenediaminetetraacetate | 20 mg/m$^2$ |
| Latex polymer f | 0.5 mg/m$^2$ |
| S-1 | 1.7 mg/m$^2$ |
| Formula 5 (Protective layer) | |
| Gelatin | 0.6 g/m$^2$ |
| Dye AD-5, solid particle dispersion (average particle size, 0.1 μm) | 40 mg/m$^2$ |
| S-1 | 12 mg/m$^2$ |
| Matting agent (monodispersed silica particles with average size, 3.5 μm) | 25 mg/m$^2$ |
| Nucleation accelerating agent Na-3 | 40 mg/m$^2$ |
| 1,3-Vinylsulfonyl-2-propanol | 40 mg/m$^2$ |
| Surfactant h | 1 mg/m$^2$ |
| Colloidal silica (average particle size, 0.05 μm) | 10 mg/m$^2$ |
| Hardener K-1 | 30 mg/m$^2$ |
| Formula 6 (Backing layer) | |
| Gelatin | 0.6 g/m$^2$ |
| S-1 | 5 mg/m$^2$ |
| Latex polymer f | 0.3 g/m$^2$ |
| Colloidal silica (average particle size, 0.05 μm) | 70 mg/m$^2$ |
| Sodium polystyrenesulfonate | 20 mg/m$^2$ |
| Compound i | 100 mg/m$^2$ |
| Formula 7 (Hydrophobic polymer layer) | |
| Latex (methyl methaacrylate:acrylic acid - 97:3) | 1.0 mg/m$^2$ |
| Hardener g | 6 mg/m$^2$ |
| Formula 8 (Backing layer) | |
| Gelatin | 0.4 mg/m$^2$ |
| Matting agent (polymethyl methaacrylate monodispersed particles with av. size of 5 μm) | 50 mg/m$^2$ |

-continued
| | |
|---|---|
| Sodium di-(2-ethylhexyl)-sulfosuccinate | 10 mg/m$^2$ |
| Surfactant h | 1 mg/m$^2$ |
| Dye k | 20 mg/m$^2$ |
| $H-(OCH_2CH_2)_{68}-OH$ | 50 mg/m$^2$ |
| Hardener K-1 | 20 mg/m$^2$ |
Compound i
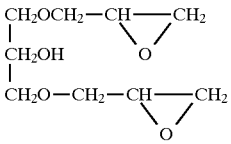
Dye k
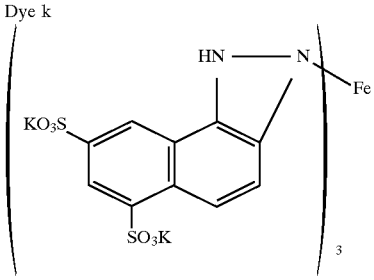
RE-1
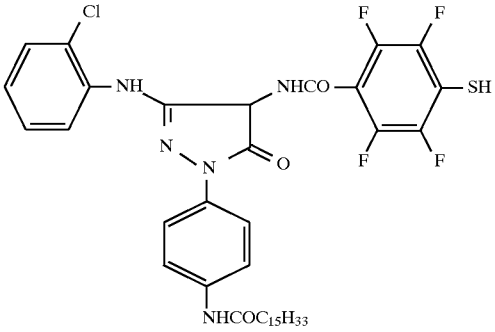
RE-2
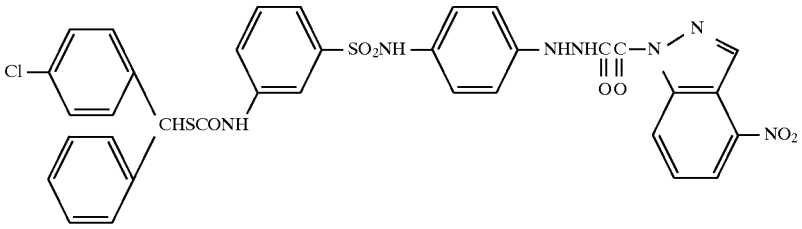
K-1
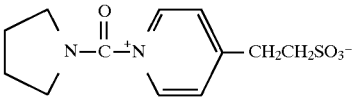
Sensitizing dye d-1
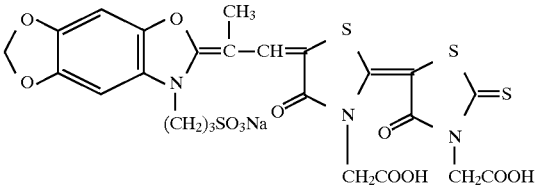

-continued
Sensitizing dye d-2
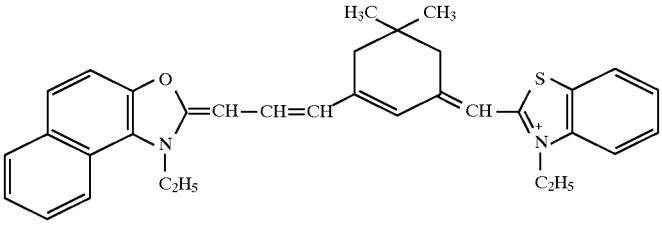
Compound e
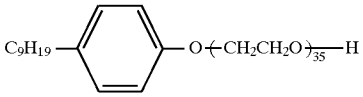
Latex polymer f
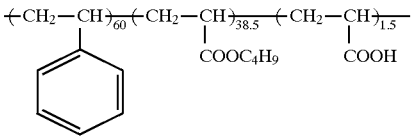
Hardener g
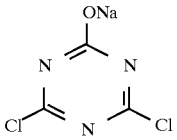
Surfactant h
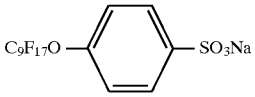
AD-1
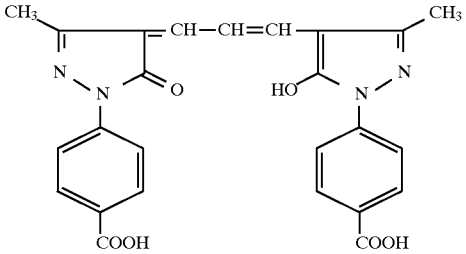
AD-5
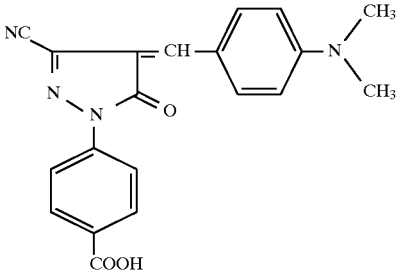

-continued

AD-8

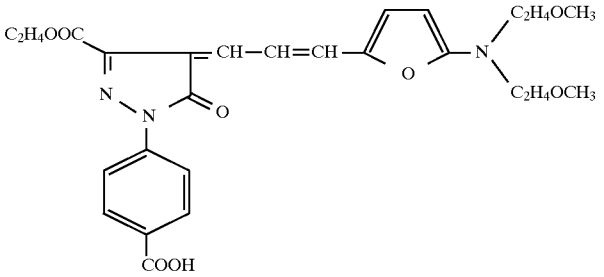

After being dried, the surface specific resistance of backing-side of the photographic material was proved to be $5\times10^{11}$ at 23° C. and 20% RH. The pH of the surface layer of the emulsion-side was 5.6.

| Processing solution formula Developer (HAD-S): (for working solution of 1 liter) | |
|---|---|
| Water | 224 ml |
| DTPA 5Na (pentasodium diethylenetriamine pentaacetate) | 1.45 g |
| Potassium sulfite | 12.54 g |
| Sodium sulfite | 42.58 g |
| KBr | 4 g |
| $H_3BO_3$ | 8 g |
| Potassium carbonate | 55 g |
| 8-Mercaptoadenine | 0.07 g |
| Diethylene glycol | 40 g |
| 5-Methylbenzotriazole | 0.21 g |
| 1-Phenyl-5-mercaptotetrazole | 0.03 g |
| 1-Phenyl-4-hydroxymethyl-4-methyl-3-pyrazolidone (Dimezone S) | 0.85 g |
| Compound represented by formula (1), as shown in Table 1 | |
| Hydroquinone | 20 g |
| KOH | 18 g |
| Water to make | 400 ml |

Water of 600 ml and the above solution of 400 ml were mixed to make a working solution of 1 liter. The pH of the working solution was 10.40.

Preparation of developer-replenishing composition in the form of a tablet (HAD-JR)

| Preparation of granular Part A (corresponding to working solution of 1 liter) | |
|---|---|
| DTPA 5Na | 1.45 g |
| Sodium carbonate (monohydrate) | 76.27 g |
| D-mannitol (trade name, product by Kao) | 6.94 g |
| Sorbitol | 2.93 g |
| LiOH | 10 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part A.

| Preparation of granular Part B (corresponding to working solution of 1 liter) | |
|---|---|
| Sodium sulfite | 56.58 g |
| KBr | 2 g |

-continued

| | |
|---|---|
| $H_3BO_3$ | 4 g |
| 8-Mercaptoadenine | 0.085 g |
| 5-Methylbenzotriazole | 0.26 g |
| 1-Phenyl-5-mercaptotetrazole | 0.06 g |
| 1-Phenyl-4-hydroxymethyl-4-methyl-3-pyrazolidone (Dimezone S) | 1.25 g |
| Sodium erythorbate | 3 g |
| Hydroquinone | 20 g |
| D-mannitol | 4.77 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules, Part B Parts A and B, and the compound of formula (1) as shown in Table 1 were completely mixed over a period of 10 min. and the mixture was tabletted using tabletting machine, Machina UD·DFE30·40 produced by Machina Co., at a tabletting pressure of 1.5 tons/$m^2$ to prepare 25 tablets with a diameter of 30 mm, thickness of 10 mm weight of 7.58 g. Further to Parts A and B, the compound of formula (1) as shown in Table 1 was added and tablets were prepared in a similar manner to the above. Thus prepared 25 tablets of each were dissolved in water of 1000 ml at 25° C. to prepare a developer solution. The pH of the working solution was 10.70.

| Fixer (HAF-S): (for working solution of 1 liter) | |
|---|---|
| Water | 116 ml |
| Ammonium thiosulfate | 140 g |
| Sodium sulfite | 22 g |
| Boric acid | 10 g |
| Tartaric acid | 3 g |
| Sodium acetate trihydride | 37.8 g |
| Acetic acid (90% aq. solution) | 13.5 g |
| Aluminum sulfate octadecahydride | 18 g |
| Water to make | 400 ml |

In practice, water of 600 ml and the above solution of 400 ml were mixed to make 1 liter of a Fixer-working solution. The pH of the working solution was 4.83.

Preparation of fixer-replenishing composition in the form of tablet

| Preparation of granular Part A (corresponding to working solution of 1 liter) | |
|---|---|
| Ammonium thiosulfate (10% Na salt, product by Hoechst) | 140 g |
| Sodium bisulfite | 7.5 g |
| Sodium acetate | 40 g |
| Pineflow (product by Matsugaya Kagaku) | 11.8 g |

Above materials were mixed over a period of 30 min. by a commercially available mill and granulated at room temperature over a period of 10 min. using a commercially available granulating machine. The resulting granules were dried at 40° C. over a period of 2 hr by a fluidized bed type drying machine to obtain granules of Part A

| Preparation of granular Part B (corresponding to working solution of 1 liter) | |
|---|---|
| Boric acid | 10 g |
| Tartaric acid | 3 g |
| Sodium hydrogensulfate | 26.5 g |
| Aluminum sulfate octadecahydrate | 15.8 g |
| D-mannitol | 4.4 g |
| N-lauroyl taurine (trade name, product by Nikko Chemicals) | 2 g |
| Demol N (trade name, product by Kao) | 5 g |

Above materials were mixed over a period of 30 min. by a commercially available bandom mill and granulated at room temperature over a period of 10 min. using a commercially available granulating machine. The resulting granules were dried at 40° C. over a period of 2 hr by a fluidized bed type drying machine to obtain granules of Part B Parts A and B were completely mixed over a period of 10 min. and the mixture was tabletted using tabletting machine, Machina UD·DFE30·40 produced by Machina Co., at a tabletting pressure of 1.5 tons/$m^2$ to prepare 25 tablets with a diameter of 30 mm and thickness of 10 mm. Thus prepared 25 tablets were dissolved in water at 25° C. to make a fixer solution of 1000 ml. The pH of the working solution was 4.20.

An automatic processor GR-26 (product by Konica Corp.) was employed. The replenishing rate of the developer replenishing solution which was prepared from tablets was shown in Table 1. The replenishing rate of the fixer replenishing solution was 195 ml/$m^2$.

Processing condition:

| Step | Temperature | Time |
|---|---|---|
| Developing | 35° C. | 30 sec. |
| Fixing | 34° C. | 20 sec. |
| Washing | Ordinary temp. | 20 sec. |
| Drying | 45° C. | 20 sec. |
| Line-speed (conveying speed): | | 984 mm/min. |

Evaluation

The photographic material, a half portion of which was light-exposed (i.e., blackening ratio of 50%) was processed using a fresh solution or running solution as a developer and evaluated with respect to sensitivity, contrast (γ) and dot quality (DQ). As the running solution was used a developer solution after 1000 sheets of the photographic material was processed.

Sensitivity (S):

Instead of exposure to He-Ne laser, the photographic material was exposed through 633 nm interference filter for 6 to 10 sec. and processed. Sensitometry was made with a densitometer PDA-65 (product by Konica). The sensitivity was shown as a relative value, based on the sensitivity at a density of 2.5 of the photographic material processed with the fresh solution being 100.

Gamma (γ):

Gamma is a contrast, defined as a tangent between densities of 0.1 and 3.0 (alternatively, a slope of a line connecting two points corresponding densities of 0.1 and 3.0).

In case of a γ-value of less than 6, the processing is impractical and even in case of not less than 6 and less than 10, it is insufficient contrast. The γ value of not less than 10 produces a super high contrast image which is sufficient for practical use.

Dot quality:

The photographic material was exposed through a random-patterned halftone screen with 16 82 m dot (FM screen) using SG-747RU (product by Dainippon Screen Co.) and processed to form a halftone dot image. Medium dots (aimed at 50% dot) were visually evaluated, using 100 times magnifier, with respect to dot quality based on five grades of 5 (the best level) and 4, 3, 2, and 1 (the worst) along with deterioration of the dot quality. Grades of not more than 2 are outside of practical use.

Silver sludge:

After photographic materials of 1,000 sheets (in which a blackening ratio of Example 1 or 3 was 50% and that of Example 2, 20%) were processed, the processing solution was allowed to stand in a beaker and was visually evaluated with respect to precipitation. The level of being transparent without precipitation was graded as rank 5. With deteriorating, ranks 4, 3, 2 and 1 were graded. Rank of 2 or less was outside of practical use, in which troubles in the processor were occurred and quality of a finished film was deteriorated.

Results thereof are shown in Table 1.

TABLE 1

| Exp. No. | Replenishing rate (ml/m$^2$) | Compound of formula (1) | | Fresh S | Fresh γ | Fresh DQ | Running S | Running γ | Running DQ | Black Spot | Sludge | Remarks |
|---|---|---|---|---|---|---|---|---|---|---|---|---|
| 1 | 300 | — | — | 100 | 12.1 | 4 | 86 | 10.2 | 3 | 3 | 3 | Comp. |
| 2 | 200 | — | — | 100 | 12.1 | 4 | 73 | 9.7 | 2 | 2 | 3 | Comp. |
| 3 | 120 | — | — | 100 | 12.1 | 4 | 61 | 9.2 | 1 | 1 | 2 | Comp. |
| 4 | 300 | 12 | (0.02*/0.5* | 100 | 12.1 | 4 | 102 | 12.0 | 4.5 | 5 | 5 | Inv. |
| 5 | 200 | 12 | (0.02/0.5) | 100 | 12.1 | 4 | 101 | 11.8 | 4 | 5 | 5 | Inv. |
| 6 | 120 | 12 | (0.02/0.5) | 100 | 12.1 | 4 | 100 | 11.7 | 4 | 5 | 4 | Inv. |
| 7 | 300 | 12 | (0.04/1.0) | 100 | 12.1 | 4 | 102 | 12.1 | 4.5 | 5 | 5 | Inv. |
| 8 | 200 | 12 | (0.04/1.0) | 100 | 12.1 | 4 | 102 | 12.0 | 4 | 5 | 5 | Inv. |
| 9 | 120 | 12 | (0.04/1.0) | 100 | 12.1 | 4 | 101 | 11.9 | 4 | 4 | 4 | Inv. |
| 10 | 300 | 15 | (0.04/1.0) | 100 | 12.1 | 4 | 101 | 12.0 | 4 | 5 | 5 | Inv. |
| 11 | 200 | 15 | (0.04/1.0) | 100 | 12.1 | 4 | 101 | 12.0 | 4 | 5 | 4 | Inv. |
| 12 | 120 | 15 | (0.04/1.0) | 100 | 12.1 | 4 | 99 | 11.9 | 4 | 5 | 4 | Inv. |
| 13 | 120 | 4 | (0.04/1.0) | 100 | 12.1 | 4 | 98 | 11.7 | 4 | 4 | 4 | Inv. |
| 14 | 120 | 7 | (0.04/1.0) | 100 | 12.1 | 4 | 100 | 11.9 | 4 | 4.5 | 4 | Inv. |
| 15 | 120 | 9 | (0.04/1.0) | 100 | 12.1 | 4 | 101 | 12.0 | 4 | 5 | 4 | Inv. |
| 16 | 120 | 13 | (0.04/1.0) | 100 | 12.1 | 4 | 99 | 11.8 | 4 | 4.5 | 4 | Inv. |
| 17 | 120 | 17 | (0.04/1.0) | 100 | 12.1 | 4 | 101 | 12.1 | 4 | 4 | 4 | Inv. |
| 18 | 120 | 19 | (0.04/1.0) | 100 | 12.1 | 4 | 102 | 12.1 | 4 | 4.5 | 4 | Inv. |

*Content of the compound in a tablet (g/tablet)
**Content of the compound in a developing solution (g/l)

As can be seen from Table 1, in the case of using a photographic material containing a hydrazine compound, the use of the inventive developer (Experiment Nos. 4 through 18) resulted in little variation in sensitivity and γ, improved dot quality and little production of black spots and silver sludge, when running-processed. It was proved that its variation was small even when processed at a lower replenishing rate.

Example 2

PREPARATION OF PHOTOGRAPHIC MATERIAL

Preparation of silver halide emulsion C

There was prepared a monodispersed silver bromochloride cubic grain emulsion having a chloride content of 98 mol % and an average grain size of 0.15 μm. During the course of grain formation was added $K_3Rh(H_2O)Br_5$ of $7\times19^{-5}$ mol per mol of silver. Further, prior to desalting was added 4-hydroxy-6-hydroxy-1,3,3a, 7-tetraazaindene of 0.6 g per mol of silver (hereinafter, unless otherwise described, the amount was denoted as per mol of silver).

The emulsion was heated to 60° C. and then 4-hydroxy-6-hydroxy-1,3,3a,7-tetraazaindene of 60 mg, sodium thiosulfate of 0.75 mg were added thereto. After 60 min., 4-hydroxy-6-hydroxy- 1,3,3a,7-tetraazaindene of 600 mg was further added and the emulsion was cooled to be set. The following layers were coated on a support in a coating amount as shown below.

| | |
|---|---|
| Emulsion layer: | |
| Silver halide emulsion C | 3.1 g/m$^2$ |
| Gelatin 10% aq. solution | 5.26 ml/m$^2$ |
| NaOH 0.5N aq. solution | 4.39 ml/m$^2$ |
| Compound (a) | 6.53 mg/m$^2$ |
| Tetrazolium compound T-7 | 40 mg/m$^2$ |
| Saponin | 107 mg/m$^2$ |
| Compound (b) | 18.5 mg/m$^2$ |
| Compound (c) | 9.8 mg/m$^2$ |

-continued

| | |
|---|---|
| Gelatin latex | 480 mg/m$^2$ |
| Polystyrenesulfonate sodium salt | 52.2 mg/m$^2$ |
| Lower protective layer: | |
| Gelatin | 0.5 g/m$^2$ |
| Compound (d) | 62.0 mg/m$^2$ |
| Citric acid | 4.1 mg/m$^2$ |
| Formalin | 1.7 mg/m$^2$ |
| Polystyrenesulfonate sodium salt | 11.0 mg/m$^2$ |
| Upper protective layer: | |
| Gelatin | 0.3 g/m$^2$ |
| Compound (e) | 18.0 mg/m$^2$ |
| Compound (d) | 48.4 mg/m$^2$ |
| Compound (f) | 105.0 mg/m$^2$ |
| Compound (g) | 1.25 mg/m$^2$ |
| Amorphous silica (av. size: 1.63 μm) | 15.0 mg/m$^2$ |
| Amorphous silica (av. size: 3.5 μm) | 21.0 mg/m$^2$ |
| Citric acid | 4.5 mg/m$^2$ |
| Polystyrenesulfonate sodium salt | 11.0 mg/m$^2$ |
| Formalin | 10 mg/m$^2$ |
| Backing layer | |
| Compound (h) | 170 mg/m$^2$ |
| Compound (d) | 30 mg/m$^2$ |
| Compound (i) | 45 mg/m$^2$ |
| Compound (j) | 10 mg/m$^2$ |
| Saponin | 111 mg/m$^2$ |
| Compound (k) | 200 mg/m$^2$ |
| Colloidal silica | 200 mg/m$^2$ |
| Compound (1) | 35 mg/m$^2$ |
| Compound (m) | 31 mg/m$^2$ |
| Compound (n) | 3.1 mg/m$^2$ |
| Polymethy methacrylate (av. size: 5.6 μm) | 28.9 mg/m$^2$ |
| Glyoxal | 10.1 mg/m$^2$ |
| Citric acid | 9.3 mg/m$^2$ |
| Polystyrenesulfonate sodium salt | 71.1 mg/m$^2$ |
| Compound (o) | 81 mg/m$^2$ |
| Compound (p) | 88.2 mg/m$^2$ |
| Calcium acetate | 3.0 mg/m$^2$ |
| Formalin | 10 mg/m$^2$ |

Addition of compounds (o) and (p), calcium acetate and formline was made by in-line-addition.

Compound (a)
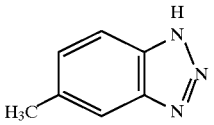
Compound (b)
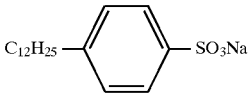
Compound (c)
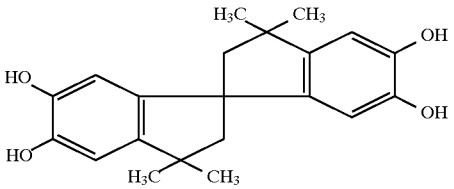
Compound (d)
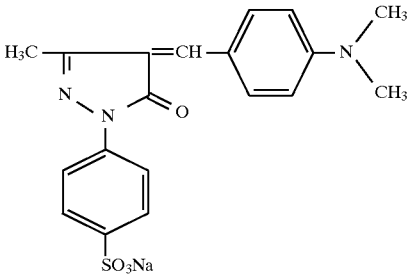
Compound (e)
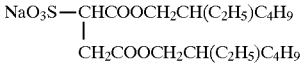
Compound (f)
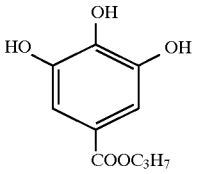
Compound (g)
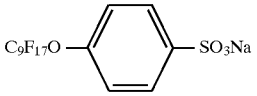
-continued
Compound (h)
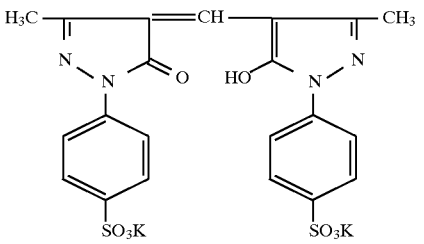
Compound (i)
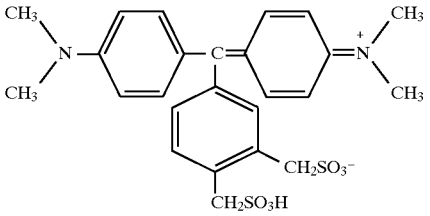
Compound (j)
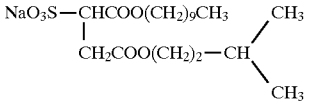
Compound (k)
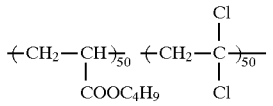
Compound (l)
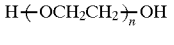
n = 34.6
Compound (m)
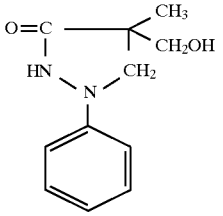
Compound (n)
$HOCH_2SO_3Na$
Compound (o)
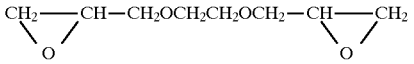

-continued

Compound (p)

$(CH_2{=}CHSO_2CH_2)_4C$

Gelatin latex

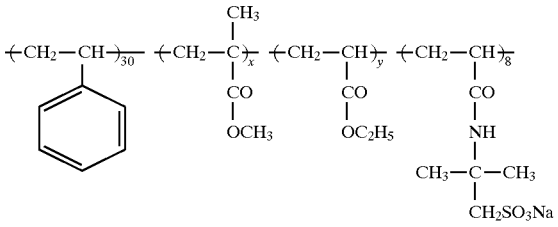

gelatin:latex = 5:1, x + y = 62

Processing solution formula Developer (TAD-S):
(used for working solution of 1 liter)

| | |
|---|---|
| Water | 350 ml |
| Pentasodium diethylenetriaminepentaacetate | 1.45 g |
| Sodium sulfite | 15.76 g |
| Potassium bromide | 2.5 g |
| Potassium carbonate | 32.8 g |
| Potassium hydrogencarbonate | 16.2 g |
| 8-Mercaptoadenine | 0.06 g |
| Diethylene glycol | 50 g |
| 5-Methylbenzotrizole | 0.5 g |
| 1-Phenyl-5-mercaptotetrazole | 0.02 g |
| 1-Phenyl-4-hydroxymethyl-4-methyl-3-pyrazolidone (Dimezone S) | 2.65 g |
| Sodium erythorbate | 60 g |

Compound represented by formula (1), as shown in Table 2 Sodium hydrogensulfate for pH adjustment Water was added to make the total amount 500 ml. Water of 500 ml and the above solution of 500 ml were mixed to make a working solution of 1 liter. The pH of the working solution was 9.80.

Preparation of developer-replenishing composition in the form of a tablet (DA)

8-Mercaptoadenine of 0.6 g and 5-methylbenzotrizole of 5.5 g were mixed and ground to granules having an average particle size of 10 μm by a commercially available bandom mill. Further thereto, sodium erythorbate (monohydrate) of 600 g, Dimezone of 24.2 g and sodium metabisulfite of 120 g was added and mixed for 30 min. The mixture was granulated, with adding water of 20 ml and an aqueous D-sorbitol solution (64%) of 100 g, by a commercially available granulating machine. The resulting granules were dried at 50° C. over a period of 90 min. by a fluidized bed type drying machine to obtain granules (DAK) having a moisture content of not more than 1% and then sieved through a 1 mm-mesh sieve under the conditions of 25° C. and 40% R.H. The granules were subjected to compression-molding using a tabletting machine (modified type of Tough Press Collect HU produced by Kikusui Seisakusho) to prepare 81 tablets each having a weight 10.05 g. Further to the granules prepared as above, the compound of formula (1) as shown in Table 2 was added to be mixed for a period of 3 min. by a cross-rotary mixer commercially available and the mixture was tabletted in a similar manner to the above to obtain tablets. Preparation of developer-replenishing composition in the form of a tablet (DB):

Potassium carbonate and potassium bromide each were mixed and ground to granules having an average particle size of 10 μm by a commercially available bandom mill. Further, Lithium hydroxide (monohydrate) of 0.5 g and 1-phenyl-5-tetrazole of 0.4 g were dissolved in water of 21 ml to prepare a solution b. DTPA (5Na) of 30 g, mannitol of 60 g and sorbitol of 30 g were mixed with potassium carbonate of 55 g and potassium bromide of 20 g which was ground as above, for 30 min. The mixture was granulated, with adding water of 4 ml and the above solution b, by a commercially available granulating machine. The resulting granules were dried at 50° C. over a period of 90 min. by a fluidized bed type drying machine to obtain granules (DBK) having a moisture content of not more than 2% and then sieved through a 1 mm-mesh sieve under the conditions of 25° C. and 40% R.H. The granules were subjected to compression-molding using a tabletting machine (modified type of Tough Press Collect HU produced by Kikusui Seisakusho) to prepare 53 tablets each having a weight of 13.04 g. Further to the granules prepared as above, the compound of formula (1), as shown in Table 2 was added to be mixed for a period of 3 min. by a cross-rotary mixer commercially available and the mixture was tabletted in a similar manner to the above to obtain tablets.

Thus prepared each DA of 81 tablets and each DB of 53 tablets were dissolved together in water to make 1 liter of develop-replenishing solution, as shown in Table 2.

As a fixing solution, the working solution employed in Example 1 was used as a starting solution and replenishing solution.

An automatic processor GR-26SR (product by Konica Corp.) was employed. The replenishing rate of the developer solution which was prepared from the concentrated solution above described was shown in Table 2. The replenishing rate of the fixer solution was 130 ml/m$^2$.

Processing condition:

| Step | Temperature | Time |
|---|---|---|
| Developing | 35° C. | 15 sec. |
| Fixing | 34° C. | 10 sec. |
| Washing | Ordinary temp. | 10 sec. |
| Drying | 45° C. | 10 sec. |
| Line-speed (conveying speed): | | 1968 mm/min. |

Evaluation

A portion of 20 % of the total area of the photographic material was exposed (i.e., blackening ratio of 20%) and processed using a fresh solution or running solution as a developer. As the running solution was used a developer solution after 1000 sheets of the photographic material was processed. The photographic material was evaluated with respect to gamma (γ) and reverse text quality Evaluation of reverse text quality (RTQ) and Gamma (γ)

A photographic material sample was imagewise exposed through a transparent original in contact with the emulsion side of the photographic material by means of a roomlight-handling printer 627FM which was provided with a light source of a non-electrode type discharge tube produced by Fusion of USA, and the processed sample was evaluated with respect to reverse text quality, based on five grades. Grade, 5 of the reverse text quality is such quality that, when exposed through halftone dots having a dot percentage of 50%, in an exposure amount that forms dots having a dot percentage of 50%, a character with 30 μm width is reproduced, therefore, it is very excellent in reverse text quality. Grade, 1 is such quality that, when exposed similarly, only character with 150 μm width is reproduced, therefore, it is poor in reverse text quality. Grades of 3 or more are levels sufficient for practical use.

The gamma (γ) is defined as below, $$\gamma=(1.0-0.1)/\{\log(\text{exposure giving a density of 1.0})-\log(\text{Exposure giving a density of 0.1})\}$$

Thus, the gamma is a gradation, defined as a tangent between densities of 0.1 and 1.0 (alternatively, a slope of a line connecting two points corresponding densities of 0.1 and 3.0). In case of a γ-value of less than 6, the processing is impractical and even in case of not less than 6 and less than 10, it is insufficient contrast. The γ value of not less than 10 produces a super high contrast image which is sufficient practical use.

Results thereof were shown in Table 2.

TABLE 2

| Exp. No. | Replenishing rate (ml/m$^2$) | Compound of formula (1) | | Fresh γ | Fresh RTQ | Running γ | Running RTQ | Sludge | Remarks |
|---|---|---|---|---|---|---|---|---|---|
| 1 | 250 | — | — | 11.7 | 4 | 10.3 | 3 | 3 | Comp. |
| 2 | 150 | — | — | 11.7 | 4 | 9.7 | 2 | 2 | Comp. |
| 3 | 120 | — | — | 11.7 | 4 | 9.1 | 1 | 1 | Comp. |
| 4 | 250 | 12 | (0.05*/0.03**/0.5***) | 11.7 | 4 | 11.8 | 4.5 | 5 | Inv. |
| 5 | 150 | 12 | (0.05/0.03/0.5) | 11.7 | 4 | 11.7 | 4.5 | 4.5 | Inv. |
| 6 | 120 | 12 | (0.05/0.03/0.5) | 11.7 | 4 | 11.5 | 4 | 4 | Inv. |
| 7 | 250 | 12 | (0.1/0.06/1.0) | 11.7 | 4 | 11.9 | 5 | 5 | Inv. |
| 8 | 150 | 12 | (0.1/0.06/1.0) | 11.7 | 4 | 11.8 | 4.5 | 4.5 | Inv. |
| 9 | 120 | 12 | (0.1/0.06/1.0) | 11.7 | 4 | 11.8 | 4.5 | 4.5 | Inv. |
| 10 | 250 | 15 | (0.1/0.06/1.0) | 11.7 | 4 | 11.8 | 4.5 | 5 | Inv. |
| 11 | 150 | 15 | (0.1/0.06/1.0) | 11.7 | 4 | 11.7 | 4 | 5 | Inv. |
| 12 | 120 | 15 | (0.1/0.06/1.0) | 11.7 | 4 | 11.6 | 4 | 4.5 | Inv. |
| 13 | 120 | 1 | (0.1/0.06/1.0) | 11.7 | 4 | 11.4 | 4 | 4 | Inv. |
| 14 | 120 | 6 | (0.1/0.06/1.0) | 11.7 | 4 | 11.6 | 4.5 | 4.5 | Inv. |
| 15 | 120 | 13 | (0.1/0.06/1.0) | 11.7 | 4 | 11.7 | 4.5 | 4 | Inv. |
| 16 | 120 | 16 | (0.1/0.06/1.0) | 11.7 | 4 | 11.8 | 4.5 | 4 | Inv. |
| 17 | 120 | 18 | (0.1/0.06/1.0) | 11.7 | 4 | 11.6 | 4 | 4.5 | Inv. |
| 18 | 120 | 21 | (0.1/0.06/1.0) | 11.7 | 4 | 11.7 | 4.5 | 4 | Inv. |

*Content of the compound in a tablet DA (g/tablet)
**Content of the compound in a tablet DB (g/tablet)
***Content of the compound in a developing so;ution (g/l)

As can be seen from Table 2, in the case of using a photographic material containing a tetrazolium compound, the use of the inventive developer (Experiment Nos. 4 through 18) resulted in little variation in sensitivity and γ, improved dot quality and little production of black spots and silver sludge, when running-processed. It was proved that its variation was small even when processed at a lower replenishing rate.

Example 3

Preparation of silver halide emulsion D

A silver bromochloride emulsion was prepare by mixing a silver nitrate solution and a solution of NaCl and KBr by double jet precipitation. During the precipitation, the mixture was maintained at 36° C., a pAg of 7.8 and a pH of 3.0 and $K_3RuCl_6$ of $8\times10^{-8}$ mol per mol of silver and $K_2IrCl_6$ of $3\times10^{-7}$ mol per mol of silver were added. Thereafter, the emulsion was desalted with phenylisocyanate-modified gelatin and then ossein gelatin was further added. The resulting emulsion was comprised of cubic silver bromochloride grains (Cl:80 mol %) with an average size of 0.18 μm and a variation coefficient of grain size of 10%.

To the thus prepared emulsion was added 4-hydroxy-6-methyl-1,3,3a,7-tetrazaindene of $1\times10^{-3}$ mol per mol of silver and after adjusting the pH and EAg, respectively, to 5.6 and 123 mV with potassium bromide and citric acid, the emulsion was chemically ripened at 60° C. by adding chloroauric acid of $2\times10^{-5}$ mol per mol of silver and N,N,N'-trimethyl-N'-heptafluoroselenourea of $2\times10^{-6}$ mol per mol of silver. After completion of chemical ripening, 4-hydroxy-6-methyl-1,3,3a,7-tetrazaindene of $3\times10^{-3}$ mol per mol of silver was added.

Preparation of silver halide photographic material for use in print-making scanner with He-Ne laser light source On one side of the subbed support above-described were simultaneously coated a gelatin subbing layer of formula 1 with a gelatin coating amount of 1.0 g/m$^2$, a silver halide emulsion layer of formula 2 with a silver coating amount of 3.5 g/m$^2$ and gelatin coating amount of 1.5 g/m$^2$, and a protective layer of formula 3 with a gelatin coating amount of 0.6 g/m$^2$, in this order from the support. On the opposite side of the support were coated a backing layer of formula 4 with a gelatin coating amount of 2.0 g/m$^2$ and further thereon a backing protective layer of formula 5 with a gelatin coating amount of 1.0 g/m$^2$ at the same time with the emulsion-side.

Formula 1 (Gelatin sublayer)

| | |
|---|---|
| Gelatin | 1.0 g/m$^2$ |
| 1-Phenyl-5-mercaptotetrazole | 1 mg/m$^2$ |
| Sodium polystyrenesulfonate | 10 mg/m$^2$ |
| S-1 (Sodium isoamyl-n-decylsulfosuccinate) | 0.4 mg/m$^2$ |
| Formula 2 (Silver halide emulsion layer) | |
| Silver halide emulsion D | 3.5 g/m$^2$ (silver equivalent amount) |
| Sensitizing dye d-1 | 3 mg/m$^2$ |
| Sensitizing dye d-2 | 3 mg/m$^2$ |
| Pyridinium compound | 52.5 mg/m$^2$ |
| Compound e | 100 mg/m$^2$ |
| Latex polymer f | 0.5 g/m$^2$ |
| Hardener g | 5 mg/m$^2$ |
| S-1 | 0.7 mg/m$^2$ |
| 2-mercapto-6-hydroxypurine | 5 mg/m$^2$ |
| Styrene-maleic acid copolymer (thickener) | 15 mg/m$^2$ |
| Sodium ethylenediaminetetraacetate | 30 mg/m$^2$ |
| Formula 3 (Protective layer) | |
| Gelatin | 0.6 g/m$^2$ |
| S-1 | 12 mg/m$^2$ |

-continued

| | |
|---|---|
| Matting agent (monodispersed silica particles with average size, 3.5 μm) | 25 mg/m$^2$ |
| 1,3-Vinylsulfonyl-2-propanol | 40 mg/m$^2$ |
| Surfactant h | 1 mg/m$^2$ |
| Colloidal silica (average particle size, 0.05 μm) | 20 mg/m$^2$ |
| Hardener j | 30 mg/m$^2$ |
| Formula 4 (Backing layer) | |
| Gelatin | 2.0 g/m$^2$ |
| S-1 | 5 mg/m$^2$ |
| Latex polymer f | 0.3 g/m$^2$ |
| Colloidal silica (average particle size, 0.05 μm) | 70 mg/m$^2$ |
| Sodium polystyrenesulfonate | 20 mg/m$^2$ |
| Compound i | 100 mg/m$^2$ |
| Formula 5 (Backing protective layer) | |
| Gelatin | 1.0 mg/m$^2$ |
| Matting agent (polymethyl methaacrylate monodispersed particles with av. size of 5 μm) | 50 mg/m$^2$ |
| Sodium di-(2-ethylhexyl)-sulfosuccinate | 10 mg/m$^2$ |
| Surfactant h | 1 mg/$^2$ |
| Dye k | 20 mg/m$^2$ |
| H—$(OCH_2CH_2)_{68}$—OH | 50 mg/m$^2$ |
| Hardener g | 20 mg/m$^2$ |

Thus prepared photographic material was evaluated in the same manner as in Example 1. Results thereof were shown in Table 3.

TABLE 3

| | | | | Fresh | | | Running | | | | | |
|---|---|---|---|---|---|---|---|---|---|---|---|---|
| Exp. No. | Replenishing rate (ml/m$^2$) | Compound of formula (1) | | S | γ | DQ | S | γ | DQ | Black Spot | Sludge | Remarks |
| 1 | 250 | — | — | 100 | 11.9 | 4 | 83 | 10.0 | 3 | 3 | 3 | Comp. |
| 2 | 150 | — | — | 100 | 11.9 | 4 | 69 | 9.3 | 2 | 2 | 2 | Comp. |
| 3 | 120 | — | — | 100 | 11.9 | 4 | 55 | 8.8 | 1 | 2 | 1 | Comp. |
| 4 | 250 | 12 | (0.02*/0.5* | 100 | 11.9 | 4 | 99 | 11.9 | 4.5 | 5 | 5 | Inv. |
| 5 | 150 | 12 | (0.02/0.5) | 100 | 11.9 | 4 | 98 | 11.8 | 4 | 4 | 4.5 | Inv. |
| 6 | 120 | 12 | (0.02/0.5) | 100 | 11.9 | 4 | 98 | 11.7 | 4 | 4 | 4 | Inv. |
| 7 | 250 | 12 | (0.04/1.0) | 100 | 11.9 | 4 | 102 | 11.9 | 4.5 | 5 | 5 | Inv. |
| 8 | 150 | 12 | (0.04/1.0) | 100 | 11.9 | 4 | 100 | 11.9 | 4.5 | 5 | 5 | Inv. |
| 9 | 120 | 12 | (0.04/1.0) | 100 | 11.9 | 4 | 100 | 11.8 | 4 | 4.5 | 4.5 | Inv. |
| 10 | 250 | 15 | (0.04/1.0) | 100 | 11.9 | 4 | 101 | 11.9 | 4.5 | 4.5 | 5 | Inv. |
| 11 | 150 | 15 | (0.04/1.0) | 100 | 11.9 | 4 | 99 | 11.7 | 4 | 4.5 | 4.5 | Inv. |
| 12 | 120 | 15 | (0.04/1.0) | 100 | 11.9 | 4 | 98 | 11.7 | 4 | 4 | 4.5 | Inv. |
| 13 | 120 | 5 | (0.04/1.0) | 100 | 11.9 | 4 | 100 | 11.8 | 4 | 4.5 | 4.5 | Inv. |
| 14 | 120 | 7 | (0.04/1.0) | 100 | 11.9 | 4 | 99 | 11.8 | 4 | 4 | 4 | Inv. |
| 15 | 120 | 9 | (0.04/1.0) | 100 | 11.9 | 4 | 101 | 11.9 | 4.5 | 4 | 4 | Inv. |
| 16 | 120 | 14 | (0:04/1.0) | 100 | 11.9 | 4 | 97 | 11.6 | 4 | 4 | 4.5 | Inv. |
| 17 | 120 | 17 | (0.04/1.0) | 100 | 11.9 | 4 | 100 | 11.9 | 4 | 4.5 | 4.5 | Inv. |
| 18 | 120 | 20 | (0.04/1.0) | 100 | 11.9 | 4 | 97 | 11.7 | 4 | 4 | 4 | Inv. |

*Content of the compound in a tablet (g/tablet)
**Content of the compound in a developing solution (g/l)

As can be seen from Table 3, in the case of using a photographic material containing a pyridinium compound, the use of the inventive developer (Experiment Nos. 4 through 18) resulted in little variation in sensitivity and γ, improved dot quality and little production of black spots and silver sludge, when running-processed. It was proved that its variation was small even when processed at a lower replenishing rate.

What is claimed is:

1. A solid developing composition for a silver halide black-and-white photographic light sensitive material comprising a developing agent represented by formula (A), and said developing composition further comprising a compound represented by formula (1) in an amount of 0.5 to 50% by weight of the developing agent:

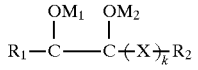

Formula (A)

wherein $R_1$ and $R_2$ independently are an alkyl group, an amino group, an alkoxy group or an alkylthio group, in which $R_1$ and $R_2$ may combine with each other to form a ring; k is 0 or 1, provided that when k is 1, X is —CO— or —CS—; and $M_1$ and $M_2$ independently are a hydrogen atom or an alkali metal atom;

Formula (1)

$$CH_3(CH_2)_n—(O)_mSO_3M$$

wherein n is an integer of 4 to 15; m is 0 or 1; and M is an alkali metal atom.

2. The developing composition of claim 1, wherein said developing composition is in the form of granules or a tablet.

3. The developing composition of claim 2, wherein said developing composition is in the form of a tablet.

4. The developing composition of claim 1, wherein said compound of formula (A) is represented by the following formula (A-a):

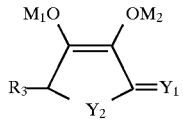

Formula (A-a)

wherein $R_3$ is a hydrogen atom, an alkyl group, an aryl group, an amino group, an alkoxy group, a sulfo group, a carboxy group, an amido group or sulfonamido group; $Y_1$ is O or S; $Y_2$ is O, S or $NR_4$, in which $R_4$ is an alkyl group or an aryl group; and $M_1$ and $M_2$ independently is a hydrogen atom or an alkali metal atom.

5. The developing composition of claim 1, wherein said developing composition comprises a compound represented by the following formula (S):

Formula (S)

$$Z^1—SM^1$$

wherein $Z^1$ is an alkyl group, an aryl group or a heterocyclic group, each of which is substituted by a substituent selected from the group consisting of a hydroxy group, —$SO_3M_1$, —$COOM_1$, an amino group and an ammonio group, in which $M_1$ is a hydrogen atom, an alkali metal atom or an ammonium group; and $M^1$ is a hydrogen atom, an alkali metal atom or an amidino group.

6. The developing composition of claim 5, wherein said compound represented by formula (S) is represented by the following formulas A through F:

Formula a

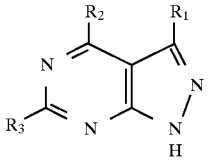

Formula B

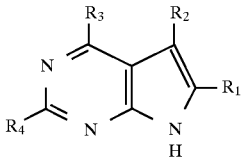

Formula C

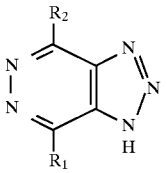

Formula D

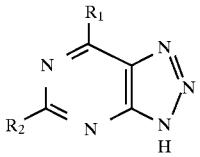

Formula E

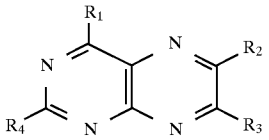

Formula F

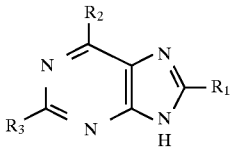

wherein $R_1$, $R_2$, $R_3$ and $R_4$ independently are a hydrogen atom, —$SM_1$, a halogen atom, an alkyl group, an alkoxy group, an alkenyl group, hydroxy group, —$COOM_2$, —$SO_3M_3$, an amino group, a carbamoyl group or a phenyl group, provided that at least one of $R_1$, $R_2$, $R_3$ and $R_4$ is —$SM_1$, in which $M_1$, $M_2$ and $M_3$ each are a hydrogen atom, an alkali metal atom or an ammonium group.

7. The developing composition of claim 1, wherein said silver halide photographic material comprising a support having thereon photographic component layers including a silver halide emulsion layer and a light-insensitive hydrophilic colloid layer, at least one of the component layers contains a hydrazine compound.

8. The developing composition of claim 1, wherein said silver halide photographic material comprising a support having thereon photographic component layers including a silver halide emulsion layer and a light-insensitive hydrophilic colloid layer, at least one of the component layers contains a tetrazolium compound.

9. The developing composition of claim 1, wherein said silver halide photographic material comprising a support having thereon photographic component layers including a silver halide emulsion layer and a light-insensitive hydrophilic colloid layer, at least one of the component layers contains at least one of pyridinium derivatives.

10. The developing composition of claim 1, wherein said silver halide photographic material comprising a support having thereon photographic component layers including a silver halide emulsion layer and a light-insensitive hydrophilic colloid layer, said silver halide emulsion layer comprising silver halide grains containing 50 mol % or more chloride.

11. The developing composition of claim 10, wherein said silver halide grains are tabular grains having an aspect ratio of a grain diameter to thickness of 2 or more, and accounting for 50% or more of the projected area of total grains contained in the layer.

12. The developing composition of claim 1, wherein said compound represented by formula (1) is contained in an amount of 2.5 to 30% by weight of the developing agent.

* * * * *